US005302811A

United States Patent [19]

Fukatsu

[11] Patent Number: 5,302,811

[45] Date of Patent: Apr. 12, 1994

[54] A POINT OF SALE APPARATUS INCLUDING A DEPOSITING/WITHDRAWING APPARATUS

[75] Inventor: Kunio Fukatsu, Ebina, Japan

[73] Assignee: Kabushiki Kaisha Toshiba, Kawasaki, Japan

[21] Appl. No.: 731,072

[22] Filed: Jul. 16, 1991

[30] Foreign Application Priority Data

Jul. 31, 1990 [JP] Japan ..... 2-203544

[51] Int. Cl.[5] ..... G07F 7/08; G07G 1/14

[52] U.S. Cl. ..... 235/381; 902/8; 364/405

[58] Field of Search ..... 235/379, 380, 381, 383, 235/384; 364/404, 405; 902/14, 21, 22, 8

[56] References Cited

U.S. PATENT DOCUMENTS

| | | | |
|---|---|---|---|
| 4,778,983 | 10/1988 | Ushikubo | 235/381 |
| 4,970,655 | 11/1990 | Winn et al. | 235/381 X |
| 5,047,613 | 9/1991 | Swegen et al. | 235/379 |
| 5,055,657 | 10/1991 | Miller et al. | 235/381 |
| 5,206,488 | 4/1993 | Teicher | 235/380 |

FOREIGN PATENT DOCUMENTS

| | | | |
|---|---|---|---|
| 3620755 | 12/1987 | Fed. Rep. of Germany | 235/381 |
| 56-123059 | 9/1981 | Japan | 235/381 |
| 57-109082 | 7/1982 | Japan | 235/381 |
| 58-207174 | 12/1983 | Japan | 364/405 |
| 59-201161 | 11/1984 | Japan | 364/405 |
| 64-36394 | 2/1989 | Japan . | |
| 2-113392 | 4/1990 | Japan | 235/381 |

*Primary Examiner*—Davis L. Willis
*Assistant Examiner*—Edward H. Sikorski
*Attorney, Agent, or Firm*—Cushman, Darby & Cushman

[57] ABSTRACT

In an article sales system, a POS terminal 100 is connected to a depositing/withdrawing apparatus 200. Purchased articles may be paid for by inserting a credit or cash card into slot 102, or a prepaid card into slot 122. Banknotes and coins are inserted into the depositing/withdrawing apparatus 209, 210. The customer selects whether excess cash inserted into the depositing-/withdrawing apparatus is to be paid to the customer in cash, or in the form of a prepaid card, or deposited in the account read from the credit or cash card.

2 Claims, 28 Drawing Sheets

(1)

TRANSACTION NO.

PURCHASED ARTICLE

| | |
|---|---|
| A1 | 10,000 YEN |
| A2 | 5,000 YEN |
| TAX | 450 YEN |
| SUBTOTAL A | 15,450 YEN |

CASH DEPOSIT

| | |
|---|---|
| 10,000-YEN NOTE | ONE |
| 5,000-YEN NOTE | ONE |
| 1,000-YEN NOTE | ONE |
| SUBTOTAL | 16,000 YEN |
| CHANGE C:(B-A) | 550 YEN |

FIG. 20A

③

TRANSACTION NO.

| | |
|---|---|
| A1 | 10,000 YEN |
| A2 | 5,000 YEN |
| TAX | 450 YEN |
| SUBTOTAL A | 15,450 YEN |
| CREDIT LOAN F | 40,000 YEN |
| CHANGE G:(F-A) | 24,550 YEN |

ABC
DEF CARD
1234 5678 9012
AVAILABLE PERIOD 04/94·ABC
MR. AKIRA TOSHIMA

F I G. 20B

②

TRANSACTION NO.

PURCHASED ARTICLE

| | |
|---|---|
| A1 | 10,000 YEN |
| A2 | 5,000 YEN |
| TAX | 450 YEN |
| SUBTOTAL A | 15,450 YEN |

CASH DEPOSIT

| | |
|---|---|
| 10,000-YEN NOTE | FOUR |
| 5,000-YEN NOTE | ONE |
| 1,000-YEN NOTE | ZERO |
| 100-YEN COIN | FOUR |
| 50-YEN COIN | ONE |
| SUBTOTAL | 45,450 YEN |

AMOUNT PAID FOR CREDIT

| | |
|---|---|
| E : ( D - A ) | 30,000 YEN |
| | YEN |

FIG. 20C (5)

TRANSACTION

PURCHASED ARTICLE

| | |
|---|---|
| A1 | 10,000 YEN |
| A2 | 5,000 YEN |
| TAX | 450 YEN |
| SUBTOTAL A | 15,450 YEN |
| AMOUNT WITHDRAWN FROM BANK | 45,450 YEN |

AMOUNT WITHDRAWN FOR CHANGE

| | |
|---|---|
| 10,000-YEN NOTE | FOUR |
| 5,000-YEN NOTE | ZERO |
| 1,000-YEN NOTE | ZERO |
| 100-YEN COIN | ZERO |
| 50-YEN COIN | ZERO |
| SUBTOTAL I (H-A) | 40,000 YEN |

YEN

YEN

FIG. 20D

④

TRANSACTION

PURCHASED ARTICLE

| | |
|---|---|
| A1 | 10,000 YEN |
| A2 | 5,000 YEN |
| TAX | 450 YEN |
| SUBTOTAL A | 15,450 YEN |

CASH DEPOSIT (J)

| | |
|---|---|
| 10,000-YEN NOTE | ONE |
| 5,000-YEN NOTE | ONE |
| 1,000-YEN NOTE | ONE |
| SUBTOTAL | 16,000 YEN |

AMOUNT DEPOSITED IN BANK K : (J-A) 550 YEN

FIG. 20E

| | TOTAL | 10,000-YEN NOTE | 5,000-YEN NOTE | 1,000-YEN NOTE | 500-YEN COIN | 100-YEN COIN | 10-YEN COIN | ONE-YEN COIN |
|---|---|---|---|---|---|---|---|---|
| 1. DEPOSITED AMOUNT | 1,661,100 | 100 | 100 | 100 | 100 | 100 | 100 | 100 |
| 2. WITHDRAWN AMOUNT | 580,550 | 50 | | 50 | 50 | 50 | 50 | 50 |
| 3. BALANCE | | 200 | 200 | 200 | 200 | 200 | 200 | 200 |
| 4. AMOUNT DEPOSITED IN BANK | 498,330 | 30 | 30 | 30 | 30 | 30 | 30 | 30 |
| 5. AMOUNT WITHDRAWN FROM BANK | 232,220 | 20 | | 20 | 20 | 20 | 20 | 20 |
| 6. AMOUNT PAID FOR CREDIT (PAYMENT) | 498,330 | 30 | 30 | 30 | 30 | 30 | 30 | 30 |
| 7. AMOUNT WITHDRAWN FROM BANK FOR CREDIT (LOAN) | 0 | 0 | | 0 | 0 | 0 | 0 | 0 |
| 8. CREDIT SALES | 500,000 | | | | | | | |
| 9. BANK SALES | 200,000 | | | | | | | |
| 10. AMOUNT DEPOSITED BY HAND | 564,440 | 30 | 40 | 40 | 40 | 40 | 40 | 40 |
| 11. CHANGE | 48,330 | | | 30 | 30 | 30 | 30 | 30 |

FIG. 21

A POINT OF SALE APPARATUS INCLUDING A DEPOSITING/WITHDRAWING APPARATUS

BACKGROUND OF THE INVENTION

1. Field of the Invention

The present invention relates to a terminal apparatus, e.g., a point of sales (POS) terminal apparatus, in an article sales system, which is installed in a convenience store or the like.

2. Description of the Art

Conventional POS systems are installed in places where consumers and retailers are in contact with each other, e.g., department stores, supermarkets, gas stations, and convenience stores. The main function of a POS is cash management in sales transactions. In addition, a POS system has a sales data collecting function, a customer information collecting function, a credit function, and the like. With these functions, a POS system has been used for the automation of a sales counter and is labor saving in business back-up operations. Furthermore, in such a system, pieces of information are processed to perform automatic replenishment-/ordering operations or to establish a business policy.

Regarding a cash register as a POS terminal used in a POS system, an operator clerk must store cash (bills and coins) in units of denominations and pick up small change. Hence, the operation load of the operator is large. For this reason, a strong demand has arisen for the automation of such cumbersome operations.

In order to satisfy this demand, for example, Published Unexamined Japanese Patent Application No. 64-36394 discloses a POS terminal apparatus for storing cash upon sorting and counting and for dispensing change.

Although this POS terminal apparatus can greatly reduce the load of an operator, the mental load of the operator is still large because he/she still deals with cash. In addition, since a cash counting/storing unit is expensive, the POS terminal apparatus cannot be easily introduced.

Furthermore, since a payment by a credit card accompanies cumbersome requirements like signatures, most customers pay in cash for articles of low prices. Accordingly, an operator must always have cash in hand, and change is undesirably increased in amount.

The mental load of the operator is inevitably increased, and hence an improvement in service with respect to customers cannot be expected.

SUMMARY OF THE INVENTION

It is an object of the present invention to provide a terminal apparatus in an article sales system, in which a payment for purchased articles sales system, in which a payment for purchased articles by means of a POS terminal apparatus and a depositing/withdrawing operation for a credit transaction by means of a depositing-/withdrawing apparatus are performed as operations associated with each other so that cash can be "purchased" as if articles are purchased.

It is another object of the present invention to provide a terminal apparatus in an article sales system, in which a POS terminal apparatus and a depositing/withdrawing apparatus are integrated so that a depositing-/withdrawing operation for a credit transaction can be performed in the process of a payment for purchased articles.

It is still another object of the present invention to provide a terminal apparatus in an article sales system, in which a depositing/withdrawing apparatus is designed such that a sales transaction is performed while a user and a clerk, who is in charge of a POS terminal apparatus, face each other. Unmanned operations are thereby prevented and the possibility of crimes are reduced, even in a convenience store of a 24-hour system.

It is still another object of the present invention to provide a terminal apparatus in an article sales system, in which cash in a POS terminal apparatus is managed by itself so that a clerk cannot arbitrarily pick up cash. The apparatus also cannot be opened like the drawer of a cash register, thereby reducing the possibility of crimes.

It is still another object of the present invention to provide a terminal apparatus in an articles sales system, in which cash need not be prepared both a POS terminal apparatus and a depositing/drawing apparatus. This arrangement facilitates management and allows the use of the depositing/withdrawing apparatus with a minimum amount of cash in hand.

It is still another object of the present invention to provide a terminal apparatus in an article sales system, which can reduce the mental load of an operator thereby improving service to customers.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

In order to achieve the above objects, according to the present invention, a terminal apparatus for use in an article sales system comprises: first means for determining total sales amount of at least one article sold to a customer; second means for determining the amount of cash received from the customer; third means connected to said first and second means, for calculating the difference between the total sales amount of the article and the amount of cash from the customer; reading means for reading account information of the customer from an identity medium; depositing means, connected to said third means and reading means for automatically depositing the difference calculated by said third means to the account corresponding to the account information read by the reading means.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 20A to 20E are views, each showing a receipt issued by a receipt printer;

FIG. 21 is a view showing storage contents of a storage unit;

DETAILED DESCRIPTION OF THE PREFERRED EMBODIMENTS

An embodiment of the present invention will be described below with reference to the accompanying drawings.

Figure 1:
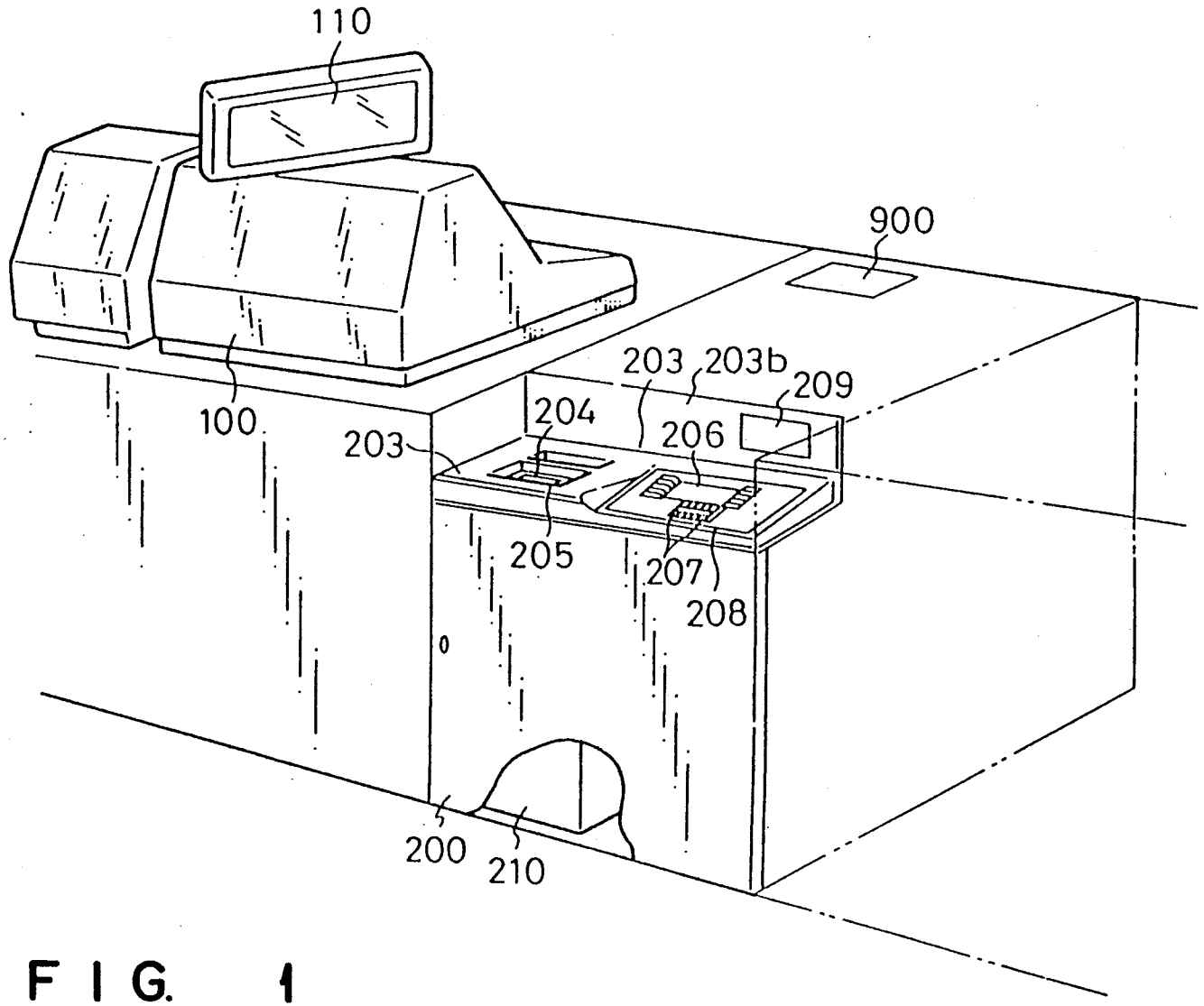
FIG. 1 is a perspective view showing a cashier counter on which a POS terminal apparatus is installed.

FIG. 1 shows a cashier counter of a convenience store or the like which has a POS terminal apparatus 1 of the present invention installed.

The POS terminal apparatus 1 comprises a cash register 100 and a depositing/withdrawing apparatus 200.

Figure 2:
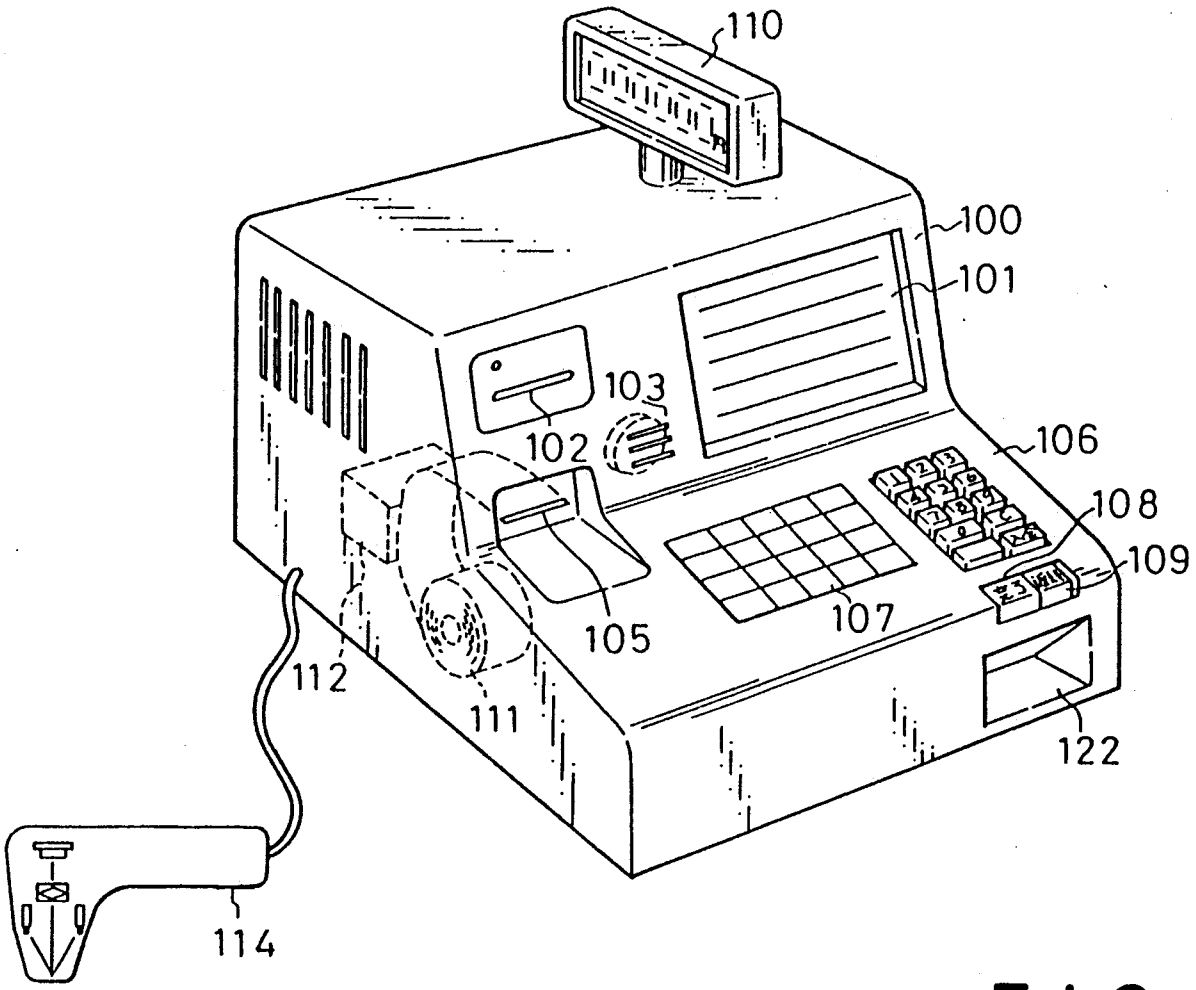
FIG. 2 is a perspective view showing an outer appearance of an arrangement of a cash register.

The cash register 100 has an arrangement shown in FIG. 2. More specifically, the cash register 100 has a stepped operation surface constituted by an upper flat surface 100*a*, a stepped portion 100*b*, and a lower flat surface 100*c*. On the upper flat surface 100*a*, a CRT display section 101, a card insertion slit 102, and a slit portion 103 for a buzzer (not shown) are arranged. A credit card or a cash card, which has the account number of a customer recorded, is inserted into the card insertion slit 102. In addition, the upper flat surface 100*a* has a receipt outlet 105 for issuing a receipt on which account items are printed. On the stepped portion 100*b*, a ten-key pad 106 and an item key section 107 are arranged. The ten-key pad 106 includes numeric keys from "0" to "9", a totalling key, and a reception key. The item key section 107 includes keys representing the types of articles for sale. An end key 108 and a return key 109 are also arranged on the stepped portion 100*b*.

A card insertion slit 122 is formed in the lower flat surface 100*c*. A prepaid card in which a change amount can be registered is issued from or inserted into the card insertion slit 122.

An LED numeric display unit 110 for indicating a purchase amount to a customer is arranged on the upper surface of the cash register 100.

A paper roll 111 is housed inside the receipt outlet 105. A receipt printer 112, which prints data on the paper roll 111, is arranged adjacent thereto. In addition, a card reader/writer 113 (see FIG. 13) is arranged inside the card insertion slit 102, which reads/writes data from/on the magnetic strip of the card inserted in the slit 102.

A hand scanner 114 and a card issue printer 115, (see FIG. 13) to be described later, are connected to the cash register 100. The hand scanner 114 automatically reads a department, an amount, and the like, represented by bar codes marked on an article.

The depositing/withdrawing apparatus 200 includes a substantially L-shaped operating portion 203 arranged on the front surface of a casing 201, as shown in FIG. 1. This operating portion 203 constitutes a horizontal operation portion 203*a* and a vertical operating portion 203*b*. A depositing/withdrawing opening 204, which serves as a reception opening and a dispensation opening, is formed in the horizontal operating portion 203*a*. A door 205 is arranged on the depositing/withdrawing opening 204 so that it can be freely opened/closed. In addition, a CRT display section 206 is arranged on the horizontal operating portion 203*a*. The CRT display section 206 displays an operation procedure and other information by illustrations or in characters. The CRT display section 206 also prompts a user as a guide. A ten-key pad 207 and selection keys 208 are arranged around the CRT display section 206. The ten-key pad 207 serves to enter a pass-word, an amount of money, and the like. The selection keys 208 serve to select a transaction and input "approval" and "disapproval" signals. A coin depositing/withdrawing opening 209 for receiving/dispensing coins is formed in the vertical operating portion 203*b*. Furthermore, a banknote depositing/withdrawing apparatus (transaction apparatus main body) 210, an internal monitor 212, and a coin depositing/withdrawing mechanism 213 are housed in the casing 201. The banknote depositing/withdrawing apparatus 210 has, e.g., a banknote receiving/dispensing function, a left banknote recovering function, a loading function, and a close inspection function. The coin depositing/withdrawing apparatus 213 serves to receive/dispense coins.

Figure 3:
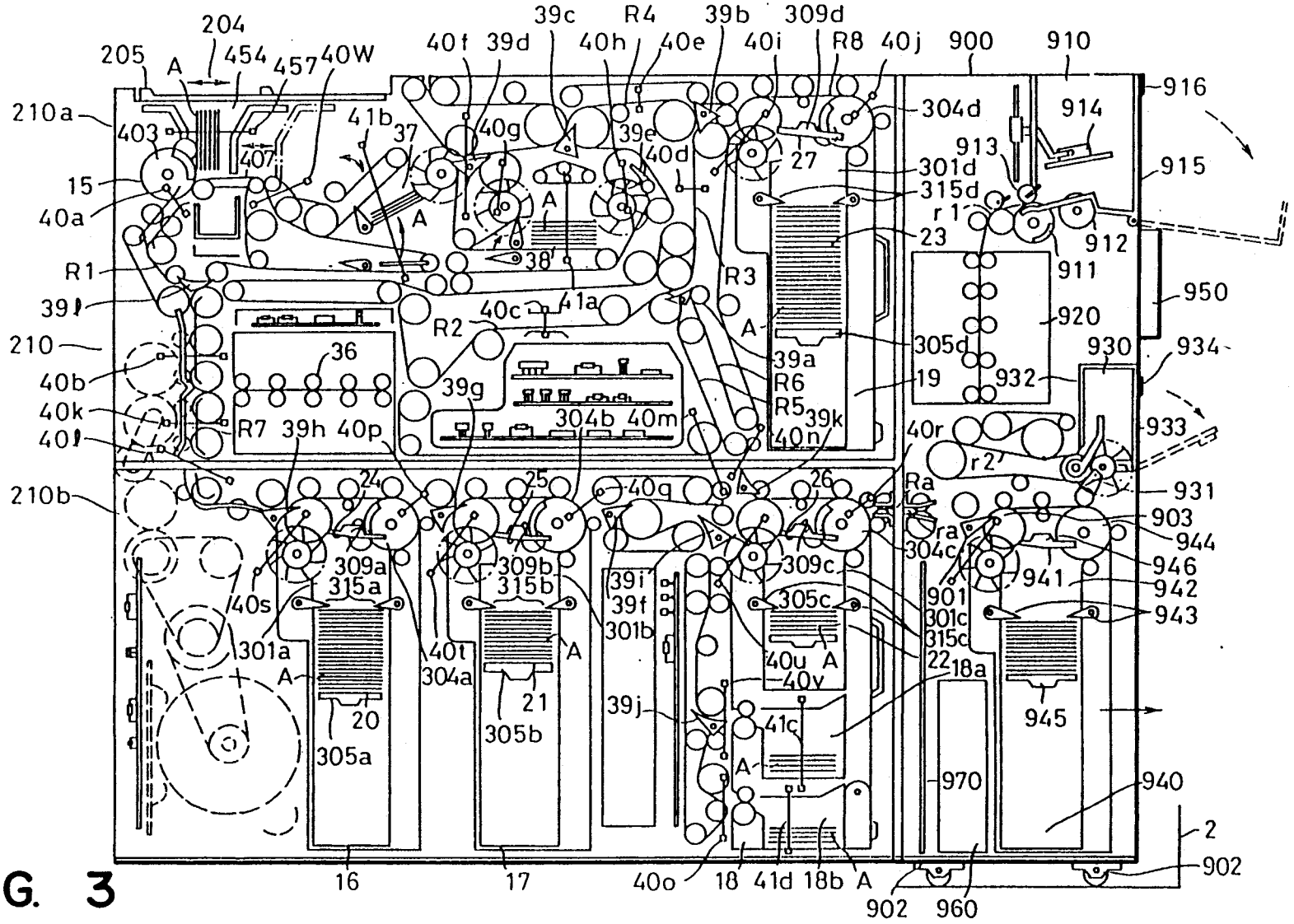
FIG. 3 is a sectional view showing an arrangement of a banknote depositing/withdrawing apparatus.

FIG. 3 shows an arrangement of the banknote depositing/withdrawing apparatus. Referring to FIG. 3, reference numeral 210*a* denotes an upper unit of the banknote depositing/withdrawing apparatus 210, and; 210*b* a lower unit thereof. An auxiliary safe unit apparatus 900 can be additionally provided as an option for the banknote depositing/withdrawing apparatus 210, which will be described later.

Referring to FIG. 3, a banknote receiving/dispensing unit 15 is arranged at an upper portion of the front surface (facing a customer) in the upper unit 210*a* in correspondence with the depositing/withdrawing opening 204. The banknote receiving/dispensing unit 15 comprises a receiving roller 403, a floor 407, and a banknote storage chamber 454. A fourth safe 19 is a loading safe and is arranged in the rear portion of the upper unit 210*a*. Fourth safe 19 constitutes a loaded banknote storage portion 23.

First and second safes 16 and 17, respectively serving as, e.g., a 10,000-yen safe and a 1,000-yen safe, are arranged in the lower unit 210*b*, they constituting banknote storage portions 20 and 21 respectively. In addition, a third safe 18 (which serves) as a depositing safe, is arranged in the lower unit 210*b*. Third safe 18 stores invalid banknotes, which are invalid as banknotes to be dispensed, banknotes to be removed, and banknotes to be recovered. Third safe 18 constitutes a banknote storage portion 22, a collecting portion 18*a*, and a recovery box 18*b*. First, second, third, and fourth collecting/extracting units 24, 25, 26, and 27 are respectively provided for the safes 16, 17, 18, and 19. In addition, flaps 315*a*, 315*b*, 315*c*, and 315*d* are arranged in the safes 16, 17, 18, and 19, respectively to form spaces 301*a*, 301*b*, 301*c*, and 301*d*. Spaces 301*a*, 301*b*, 301*c*, and 301*d* are collecting portions capable of collecting banknotes. The collecting/extracting units 24, 25, 26, and 27 are respectively constituted by pickup rollers 304*a*, 304*b*, 304*c*, and 304*d*, elevators 305*a*, 305*b*, 305*c*, and 30*d*, and press plates 309*a*, 309*b*, 309*c*, and 309*d*.

An inspection section 36 is arranged in the upper unit 210 at a front center portion in the vertical direction. On the right of the inspecting section 36, a dispensed-banknote temporary collecting portion 37 and a received-banknote temporary collecting portion 38 are arranged.

Note convey paths (R to R8) are formed in the units 210*a* and 210*b* to convey banknotes A to the respective portions. In addition, gates 39*a* to 39*b* utilize rotary solenoids (not shown) as driving sources and are respectively arranged at branch portions Banknote passage detectors 40*a* to 40*w* are respectively arranged midway along the banknote convey paths R. Furthermore, banknote detectors (remainder check sensor) 41*a* to 41*d* and 457 are respectively arranged at collecting portions where the banknotes A are collected. Each of the banknote passage detectors 40*a* to 40*w* and the banknote detectors 41*a* to 41*d* and 457 has a known arrangement constituted by a light-emitting element and a light-receiving element.

A convey path inlet Ra is formed in the rear portion of the lower unit 210*b* to convey banknotes from the auxiliary safe unit apparatus 900 into the depositing-/withdrawing mechanism 12.

An operation (the flow of banknotes) in the above-described arrangement will be described below.

Figure 4:
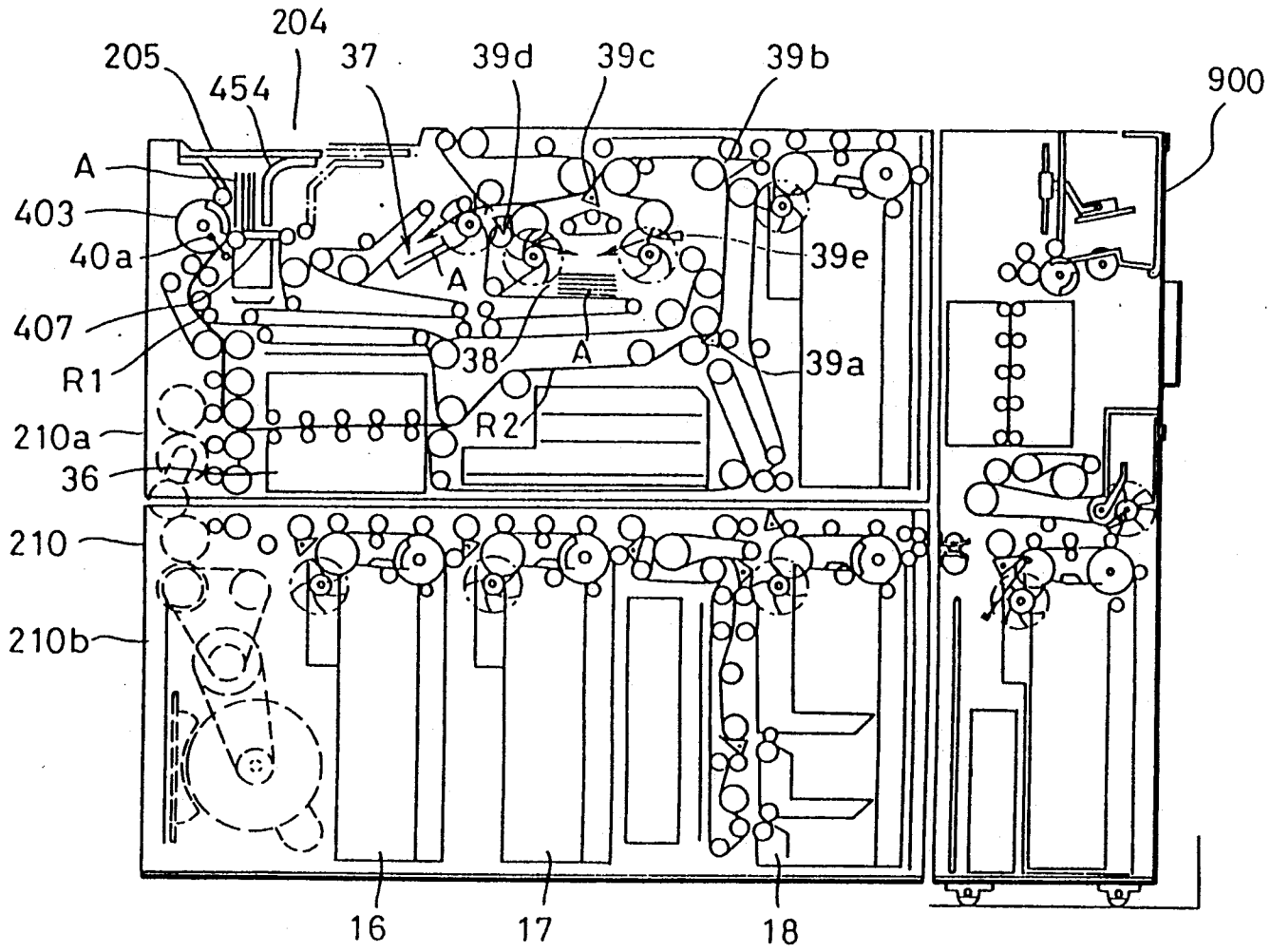
FIGS. 4 and 5 are sectional views showing the flow of banknotes in a depositing operation.
Figure 5:
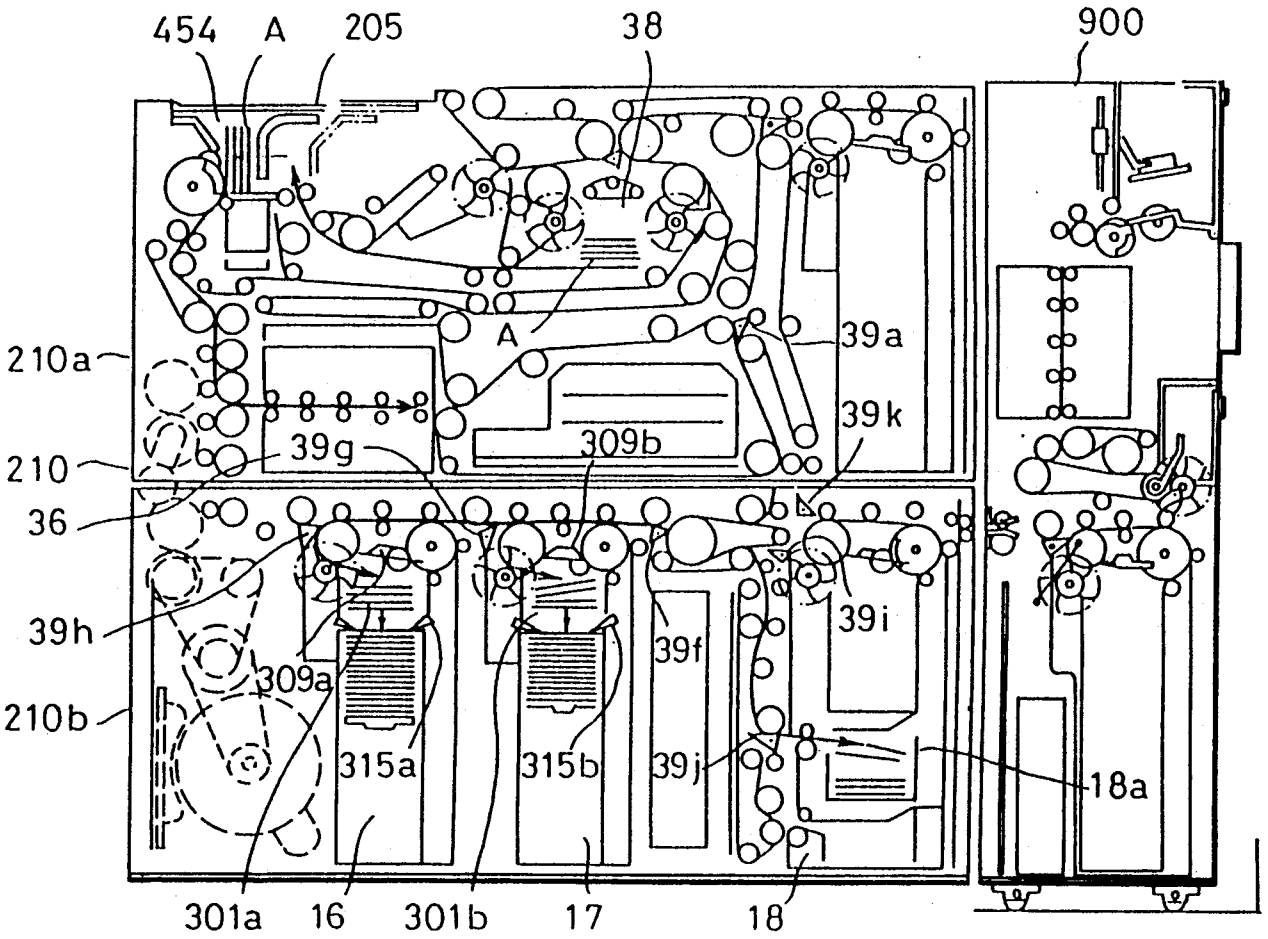

FIGS. 4 and 5 are views showing the flow of banknotes in a depositing operation.

When, for example, a display portion corresponding to "deposit" of the CRT display section 206 is depressed by a user, the door 205 of the depositing/withdrawing opening 204 is opened. In this state, the user puts banknotes A of various denominations together into the banknote storage chamber 454 in a vertical position with the upper surfaces of the various denominations facing in different directions. The door 205 is then closed. When it is detected that the door 205 is closed, the floor 407 is vertically vibrated to align the banknotes A. Thereafter, the receiving roller 403 is rotated and receives the banknotes A, one by one, starting with the forefront banknote. The banknotes A received by this receiving roller 403 are conveyed through the banknote convey path R1 and are counted by the banknote passage detector 40*a*.

The banknotes A are guided to the inspecting section 36 where their denominations (types of banknotes), authenticity, and directions of their upper surfaces are discriminated (judged). The banknotes A which are conveyed through the banknote convey path R2 and are discriminated by the inspecting section 36 to be banknotes whose upper surfaces face in a forward direction are conveyed upward through a first distribution gate 39*a* and are further conveyed through second and third distribution gates 39*b* and 39*c*. Subsequently, the direction of these banknotes A is changed by a fourth distribution gate 39*d*. The banknotes A are collected in the received-banknote temporary collecting portion 38.

The banknotes A which are discriminated to be banknotes whose upper surface face in a reversed direction are conveyed through the first and second distribution gates 39*a* and 39*b*. The route of these banknotes A is then changed by the third distribution gate 39*c* and by a fifth distribution gate 39*e* and are reversed and collected in the received-banknotes temporary collecting portion 38. With this operation, the banknotes A are collected in the collecting portion 38 with their upper surface facing in the same direction.

If the banknote A is discriminated by the inspecting section 36 to be a rejected banknote, e.g., a counterfeit banknote or a banknote which cannot be judged, the rejected banknote A is conveyed to and collected by a dispensed-banknote temporary collecting portion 37 through the first, second, third, and fourth distribution gates 39*a*, 39*b*, 39*c*, and 39*d*. When there are no more banknotes A in the banknote storage chamber 454, the rejected banknote A collected in the dispensed-banknote temporary collecting portion 37 are dispensed into the storage chamber 454 as a bundle. Thereafter, the door 205 is opened to return the banknotes to the user. The banknotes A collected in the received-banknote temporary collecting portion 38 are conveyed to the banknote storage chamber 454 as a bundle and are taken in and conveyed again when, for example, the user inputs a "confirmation" signal through the CRT display section 206. The received banknotes A are inspected. Thereafter, the convey path R is switched to a downward path by the first distribution gate 39*a* so that the banknotes A are conveyed to the lower unit 210*b*.

The banknotes which are discriminated by the inspecting section 36 to be 10,000-yen banknotes are horizontally conveyed through eleventh, sixth, and seventh gates 39*k*, 39*f*, and 39*g*. The route of the 10,000-yen banknotes is then changed by an eighth gate 39*h*, and the banknotes are collected in a collecting portion 301*a* of a 10,000-yen safe.

The route of 1,000-yen banknotes is changed by the seventh distribution gate 39*g*, and the banknotes are collected in a collecting portion 301*b* of a 1,000-yen safe 17.

Old 10,000- and 1,000-yen notes, 5,000-yen notes, and rejected banknotes are changed in route by the sixth distribution gate 39*f* and are collected in the depositing safe 18 through ninth and tenth distribution gates 39*i* and 39*j*.

When all the banknotes A are collected in the collecting portions 301*a*, 301*b*, and 18*a* of the respective safes 16, 17, and 18, the banknotes A in the safes 16 and 17 are pressed downward by the press plates 309*a* and 309*b*. Then they are locked by the flappers 315*a* and 316*b* and stored below the flappers 315*a* and 315. The depositing operation is thereby completed. If a "disapproval" signal is input while the banknotes A are collected in the received-banknote temporary collecting portion 38, the banknotes A in the collecting portion 38 are returned to the banknote storage chamber 454. Thereafter, the door 205 is opened to return the banknotes A to the user.

After the banknotes A are taken out from the banknote storage chamber 454, the door 205 is closed.

Figure 6:
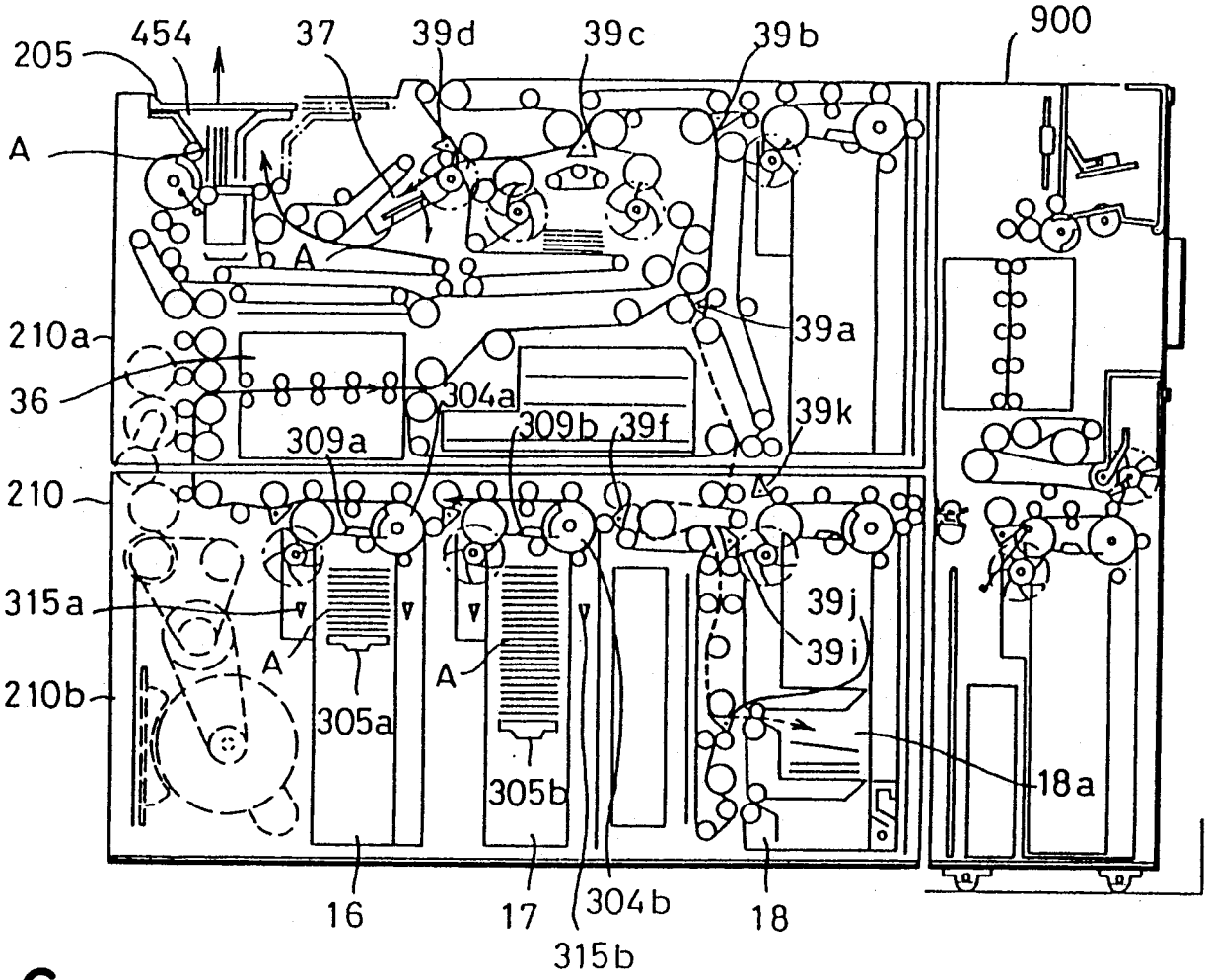
FIG. 6 is a sectional view showing the flow of banknotes in a withdrawing operation.

FIG. 6 shows the flow of each banknote in a withdrawing operation.

Initially, a withdrawal transaction is selected, and the amount of money to be withdrawn is input. To prepare for a withdrawing operation, in the respective safes 16 and 17, the stored banknotes A are pressed downward by the press plates 309*a* and 309*b* to release the locking of the flappers 315*a* and 315*b*. Furthermore, the elevators 305*a* and 305*b* are moved upward to take out the banknotes A and bring them into contact with the pickup rollers 304*a* and 304*b*.

10,000- and 1,000-yen banknotes are picked up one by one from the 10,000-yen safe 16 and the 1,000-yen safe 17, respectively, by rotating the pickup rollers 304*a* and 304*b*. The picked 10,000- and 1,000-yen banknotes are respectively counted and horizontally conveyed forward to be guided into the upper unit 210*a*. These banknotes are then conveyed to the inspecting section 36. The banknotes A which are discriminated to be authentic by the inspecting section 36 are collected in the dispensed-banknote temporary collecting portion 37 through the first, second, third, and fourth distribution gates 39*a*, 39*b*, 39*c*, and 39*d*. When the collected banknotes A reach a designated amount of money, the pickup operation is stopped. Thereafter, the dispensed banknotes A collected in the dispensed-banknote temporary collecting portion 37 are released as a bundle to the banknote storage chamber 454. The door 18 is then opened to dispense the banknotes A to the user. After the user takes out the banknotes A, the door 18 is closed, thus completing the withdrawal transaction.

Note that the banknotes A which are discriminated to be banknotes unsuitable for dispensation by the inspecting section 36 are conveyed to the lower unit 210*b* through the first distribution gate 39*a*. The rejected banknotes are then conveyed to the collecting portion 18*a* of the depositing safe 18 through the eleventh, sixth, ninth, and tenth distribution gates 39*k*, 39*f*, 39*i*, and 39*j* and are collected in the collection portion 18*a*.

Figure 7:
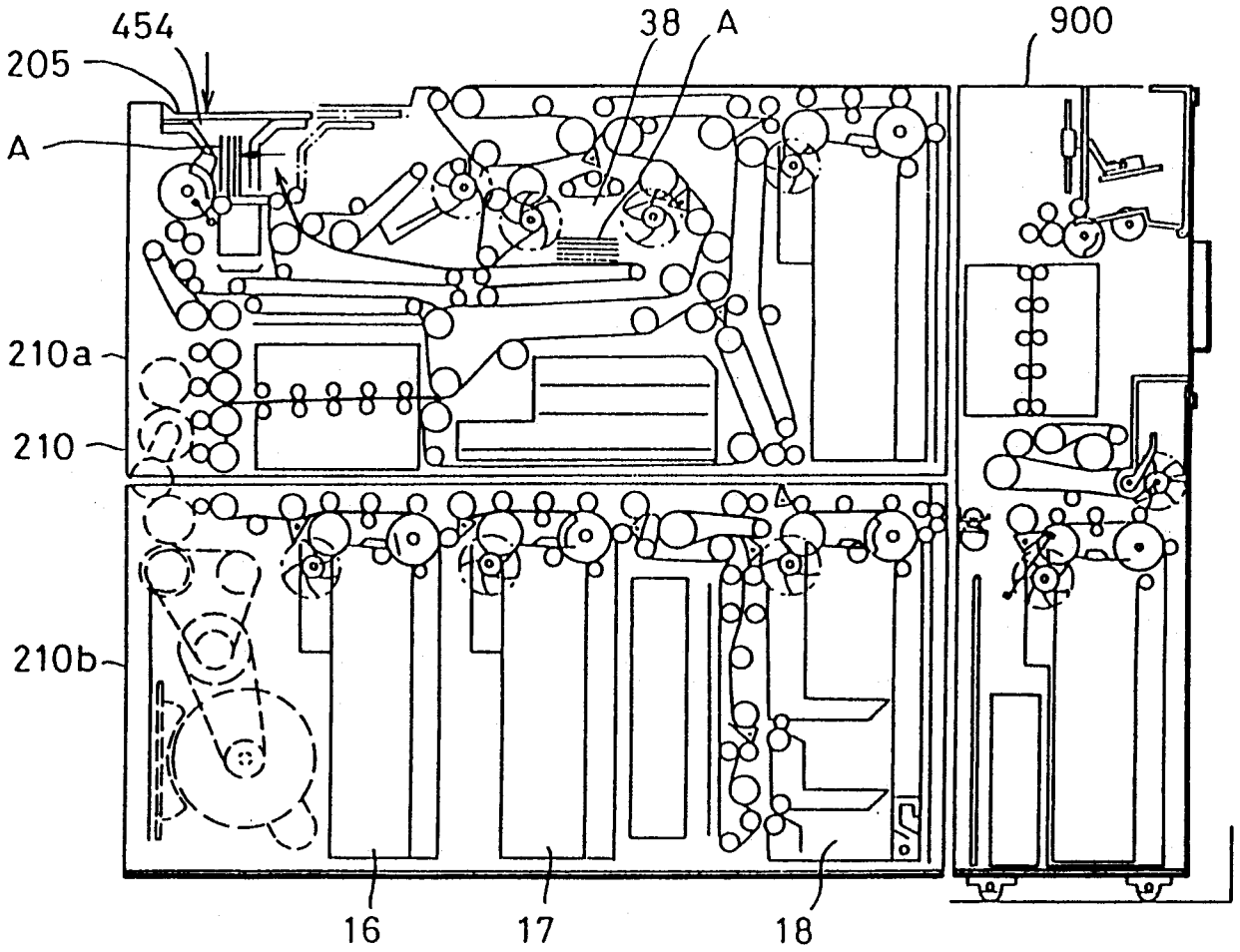
FIG. 7 is a sectional view showing the flow of banknotes in a deposited banknote returning operation.

The flow of each banknote in a received-banknote returning operation will be described below with reference to FIG. 7.

If, for example, a "cancel" signal is input through the CRT display section 206 after the banknotes A are collected in the received-banknote temporary collecting portion 38 in a depositing operation, the banknotes A are released as a bundle to the banknote storage chamber 454. Thereafter, the door 205 is opened to return the banknotes A to a user.

Figure 8:
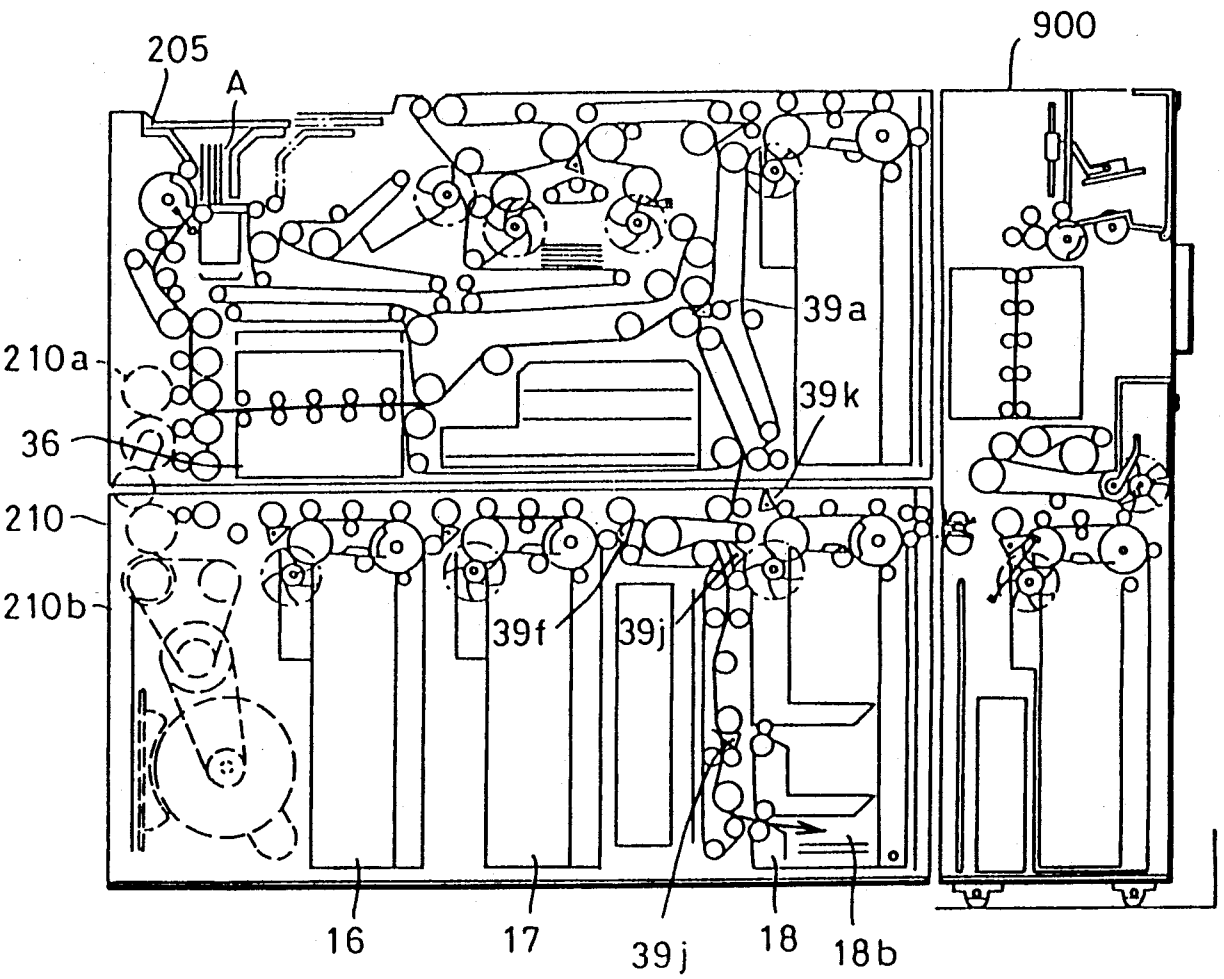
FIG. 8 is sectional view showing the flow of banknotes in recovery operation of banknotes when a customer forgets to remove them.

FIG. 8 shows the flow of each banknote in a case where the banknotes A a user forgets to take out are recovered.

If the user does not take out the dispensed banknotes A in a predetermined period of time after the door 205 is opened, the door 205 is first closed. Then, the banknotes A are taken in, one by one, to be recovered by the recovery box 18*b* in the depositing safe 18 through the inspecting section 36 and the first, eleventh, sixth, ninth, and tenth distribution gates 39*a*, 39*k*, 39*f*, 39*i*, and 39*j*.

Figure 9:
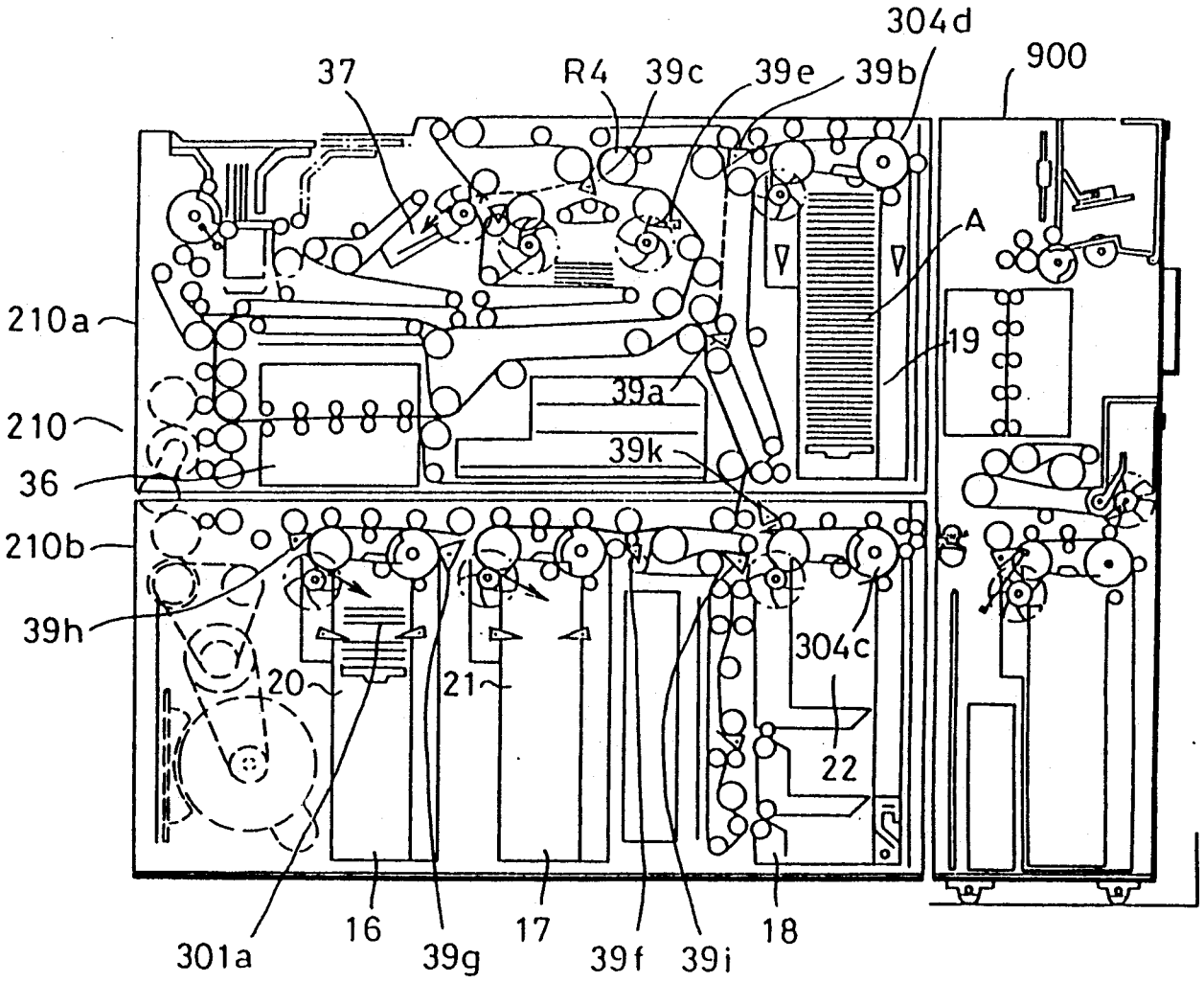
FIG. 9 is a sectional view showing the flow of banknotes in a banknote loading operation.

The flow of each banknote in a banknote loading (replenishing) operation will be described below with reference to FIG. 9.

If a banknote loading mode is selected by a clerk and the banknotes A are set in the loading safe 19, a loading operation of the banknotes A is started.

The banknotes A are picked up one by one by the pickup roller 30*d* of the loading safe 19 and are conveyed to the inspecting section 36 through the second, third, and fifth distribution gates 39*b*, 39*c*, and 39*e*. In the inspecting section 36, the denominations are judged. The banknotes A judged by the inspecting section 36 are conveyed downward through the first distribution gate 39*a* and are further conveyed through the eleventh and sixth distribution gates 39*k* and 39*f*. The route of 1,000-yen banknotes is changed by the seventh distribution gate 39*g*, and the banknotes are collected in the collecting portion 301*b* of the 1,000-yen safe 17. 10,000-yen banknotes are conveyed through the seventh distribution gate 39*g*, and their route is changed by the eighth distribution gate 39*h*. The banknotes are then collected in the collecting portion 301*a* of the 10,000-yen safe 16. Subsequently, the 1,000- and 10,000-yen banknotes are respectively stored in the banknote storage portions 20 and 21 under pressure.

The banknotes A which are judged by the inspecting section 36 in the loading operation to be rejected are distribution upward by the first distribution gate 39*a* and are collected in the deposited-banknote temporary collecting portion 37 through the second and third distribution gates 39*b* and 39*c*. At this time, banknotes which are to be loaded pass through the second distribution gate 39*b* and the rejected banknotes overlap each other in the convey path R4 between the second and third distribution gates 39*b* and 39*c*. For this reason, if banknotes are rejected, a pickup operation of banknotes to be loaded is immediately stopped. The pickup operation is then resumed after the rejected banknotes pass through the convey path R4. Alternatively, the picked banknotes which are to be loaded and the rejected banknotes are conveyed while they overlap each other, and both the types of banknotes are collected in the dispensed-banknote temporary collecting portion 37. Subsequently, when the banknotes A in the loading safe 19 run out, the loading operation is completed.

Figure 10:
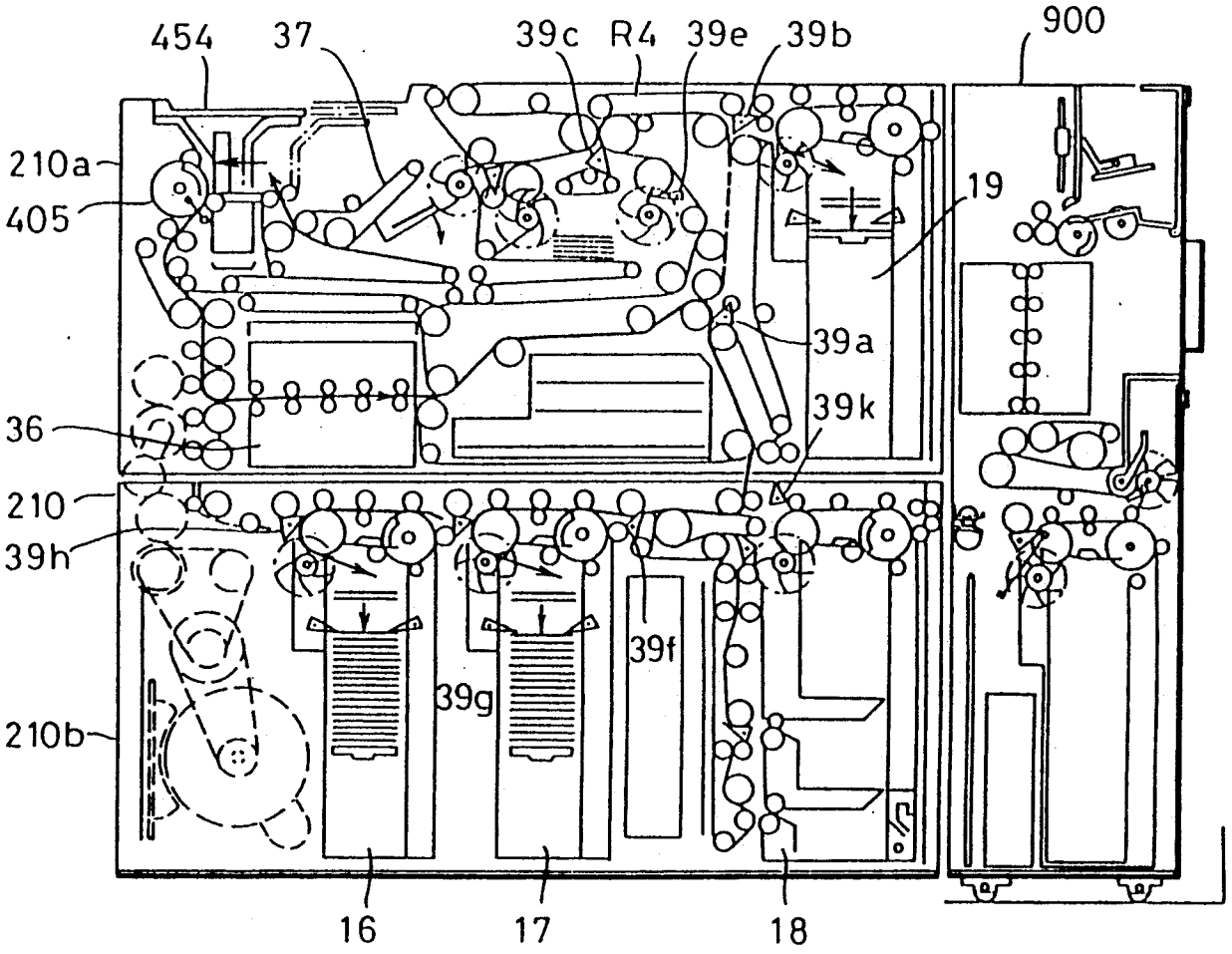
FIG. 10 is a sectional view showing the flow of rejected banknotes.

If banknotes are rejected, they are conveyed from the dispensed-banknote temporary collecting portion 37 to the banknote storage chamber 454, as shown in FIG. 10. Subsequently, the rejected banknotes are received, one by one, by the receiving roller 403 and are judged by the inspecting section 36 again. The banknotes whose denominations are discriminated are guided to the lower unit 210*b* through the first distribution gate 39*a* and are stored in the corresponding safes 16 and 17.

Those banknotes which are rejected again are guided upward through the first distribution gate 39*a*. The route of the rejected banknotes is then changed by the second distribution gate 39*b*. The banknotes are then stored in the loading safe 19.

In the above-described embodiment, the banknotes A are loaded only from the loading safe 19 in a loading operation. However, a loading operation can be performed by setting banknotes (to be loaded) in the banknote storage portion 22 of the depositing safe 18.

Figure 11:
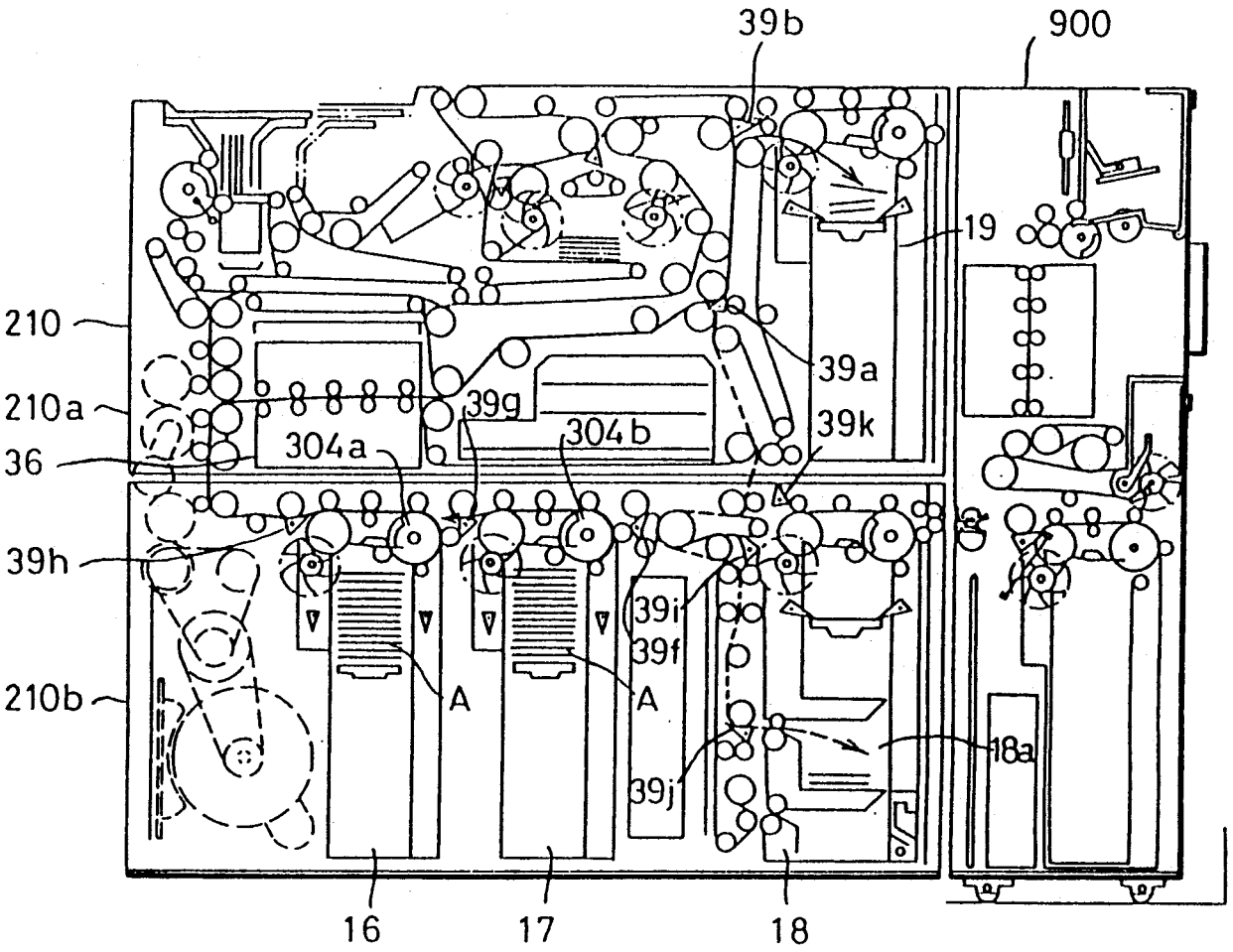
FIG. 11 is a sectional view showing the flow of banknotes in a close inspection.

The flow of each banknote in a close inspecting operation with be described below with reference to FIG. 11.

The banknotes taken out from the 10,000-yen safe 16 or the 1,000-yen safe 17 are conveyed to the upper unit 210*a* and are judged by the inspecting section 36. Subsequently, the route of the banknotes is changed by the first and second distribution gates 39*a* and 39*b* so that the banknotes are stored in the loading safe 19.

If rejected notes, e.g., banknotes which cannot be judged, are discriminated by the inspecting section 36, the rejected banknotes are conveyed downward through the first distribution gate 39*a* and are collected in the collecting portion 18*a* of the depositing safe 18 through the eleventh, sixth, ninth, and tenth distribution gates 39*k*, 39*f*, 39*i*, and 39*j*.

In the embodiment described above, the first safe 16 is used as the 10,000-yen safe; the second safe 17, the 1,000-yen safe; the banknote storage portion 20 of the third safe 18, the depositing safe; and the fourth safe 19, the loading safe. However, the first safe 16 may be used as a 1,000-yen safe or a safe for storing banknotes of other denominations. In addition, the second safe 17 may be used as a 10,000-yen safe or a safe for storing banknotes of other denominations. Furthermore, and especially in a case wherein the depositing/withdrawing apparatus 210 is used during holidays safes 18 and 19 can be used as dispensing safes, if banknotes for dispensation or replenishment are stored in the banknote storage portion 22 of the third safe 18 and the loading safe 19.

An arrangement of the auxiliary safe unit apparatus 900 will be described below with reference to FIG. 3.

The auxiliary safe unit apparatus 900 comprises: a hopper portion 910, which an operator of the cash register 100 puts banknotes from the rear side of the depositing/withdrawing apparatus 200: and inspecting unit 920, for judging and inspecting banknotes: a rejected banknote collecting portion 930, for collecting banknotes discriminated by the inspecting unit 920 to be invalid banknotes (rejected banknotes); an auxiliary safe 940, for storing banknotes discriminated to be banknotes suitable for dispensation; an operation panel 950, operated by a clerk; a power supply 960, for driving the unit apparatus 900, and a control circuit 970.

The hopper portion 910 is constituted by a receiving roller 911, a feed roller 912, a gate roller 913, and a backup mechanism 914. The backup mechanism 914 is vertically moved to urge banknotes against the respective rollers 911, 912, and 913. The hopper portion 910 separates banknotes one by one starting from the lowermost banknote and feeds to a convey path r1.

The inspecting unit 920 judges the appropriate physical properties of a banknote conveyed through the convey path r1 on the basis of, its thickness and shape.

The rejected-banknote collecting portion 930 is constituted by a distribution gate 931 and a collecting box 932. The distribution gate 931 separates banknotes conveyed through a convey path r2 into proper banknotes and rejected banknotes. Rejected banknotes are discriminated by the inspecting unit 920 to be counterfeit, damaged banknotes unsuitable for dispensation or banknotes which cannot be judged because two banknotes are simultaneously received. The collecting box 932 collects rejected banknotes distributed by the gate 931. Similar to the hopper portion 910, the rejected-banknote collecting portion 930 has a door 933. A key 934 is provided for the door 933. With this arrangement, if the door 933 is kept open while banknotes from the hopper portion 910 are received, the clerk can reset rejected banknotes in the hopper portion 910 or can return them in the cash register 100. If the door 933 is closed and the key 934 is turned to lock the door 933, the rejected-banknote collecting portion 930 can be also used as a safe for safely storing rejected banknotes.

The auxiliary safe 940 has the same arrangement as safes 16, 17, or 19 in the lower unit 210*b* and is detachably arranged in the rear portion of the auxiliary safe unit apparatus 900. In addition, the auxiliary safe 940 includes a collecting/extracting unit 941 and flaps 943 which form a space 942 capable of collecting approximately 100 banknotes. The collecting/extraction unit 941 comprises a pickup roller 944, an elevator 945, a press plate 946, and the like. The auxiliary safe 940 can be used as a safe for temporarily storing banknotes when the safes 16 and 17 of the depositing/withdrawing mechanism 12 are replenished with banknotes, as will be described later. Alternatively, the auxiliary safe 940 may be used to store banknotes of a given denomination thereby serving as a second 10,000-yen safe (or 1,000-yen safe) and increasing the storage capacity of banknotes.

In the auxiliary safe unit apparatus 900, a banknote convey path outlet ra is formed in correspondence with the convey path inlet Ra so as to convey banknotes to the lower unit 210*b*. In addition, a distribution gate 901, having a rotary solenoid (not shown) as a driving source, is arranged at a branch portion between the banknote convey path outlet ra and the auxiliary safe 940. Furthermore, in the auxiliary safe unit apparatus 900, banknote passage detectors and banknote detectors (remainder check sensors) 903, each consisting of a light-emitting element and a light-receiving element, are arranged at various positions.

The power supply 960 and the control circuit 970 are mounted in the auxiliary safe unit apparatus 900 so that the apparatus 900 can be independently driven when it is separated from the banknote depositing/withdrawing apparatus 210. For example, when banknotes are to be set in the safe 16 is attached to the auxiliary safe 940. By independently driving the auxiliary safe unit apparatus 900 in this state, the safe 16 can be loaded and replenished with banknotes.

Figure 12:
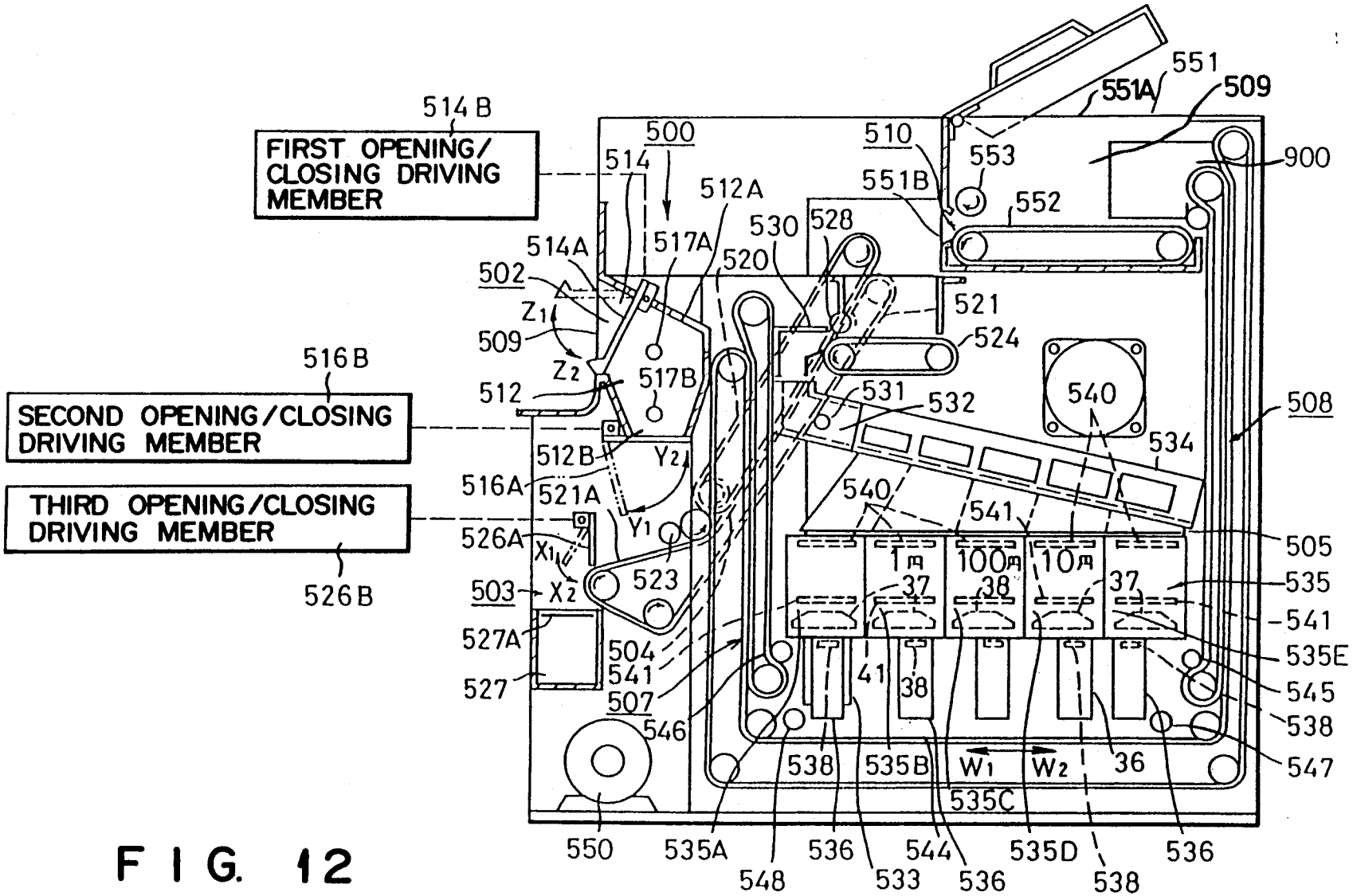
FIG. 12 is a sectional view showing a structure of a coin depositing/withdrawing apparatus.

FIG. 12 shows a structure of the coin depositing-/withdrawing apparatus 213. A coin processing unit 500 will be briefly described first. The coin processing unit 500 comprises: a received/dispensed coin guide portion 502 in which coins received from a coin outlet/inlet 501 and coins to be removed therefrom are guided; a left coin storage portion 503 for storing coins which a user forgets to take out from the coil outlet/inlet 501; a reception convey path 504 for conveying coins upward inserted into the received/dispensed coin guide portion 502 by a user; a classifying storage portion 505 for storing the coins in units of their denominations which are conveyed upward through the reception convey path 504 when they are guided downward by utilizing the force of gravity; a discharge convey path 507, for conveying coins extracted from the classifying storage portion 505 for dispensation corresponding to a desired amount of money to the received/dispensed coin guide portion 502; a recovery convey path 508 for conveying coins extracted from the classifying storage portion 505 upward to recover time; a preserving portion 509 for receiving and preserving coins conveyed through the recovery path 508 or coins inserted by an operator of the cash register 100; and a convey path 510 for extracting coins from the preserving portion 509 and conveying them to the reception portion 509 and conveying them to the reception convey path 504. The coin processing unit 500 is operated by a user or clerk to perform the following: reception processing for storing coins, which are inserted in the coin outlet/inlet 501, in the classifying storage portion 505; dispensation processing for extracting a predetermined amount of coins from the classifying storage portion 505 and guiding them into the received/dispensed coin introducing portion 502; recovery processing for recovering coins from the classifying storage portion 505 into the preserving portion 509; and replenishment processing for replenishing the classifying storage portion 505 with coins preserved in the preserving portion 509.

The received/dispensed coin introducing portion 502 is designed such that an introduction space 512 for received coins is constituted by a frame to communicate with the coin outlet/inlet 501. A coin dispensation opening 512A is formed in a deep portion which opposes the coin outlet/inlet 501, and a coin drop opening 512B is formed in a bottom portion. A coin door opening/closing mechanism 514 consisting of a coin door 514A and a first opening/closing driving member (e.g., a rotary solenoid) 514B is arranged at the coin outlet/inlet 501. The coin door 514A is pivotally supported in directions indicated by arrows Z1 and Z2 in FIG. 12. The first opening/closing driving member 514B serves to open/close the coin door 514A. Arranged the coin drop opening 512B, there is a coin mounting member 516A, on which coins inserted from the coin outlet/inlet 501 and coins dispensed from the coin dispensation opening 512A are mounted, and a driving member 516B (a second opening/closing driving member] hereinafter). The coin mounting member 516A is pivotally supported in directions indicated by arrows Y1 and Y2 in FIG. 12. The driving member 516B causes the coin mounting member 516A to pivot, thus causing the coins mounted on the member 516A to drop.

Transmission type first and second optical sensors 517A and 517B, which optically detecting a hand of a user, inserting a coin in the coin outlet/inlet 501, are arranged in the introduction space 512 as a removal discriminating means. The discriminating means whether coins on the coin mounting member 516A are removed by pivoting the coin outlet/inlet 501. In addition, a time counting means (not shown) is arranged in the introduction space 512 The counting means starts counting when the hand detected by the optical sensors 517A and 517B is not detected, and discriminates that the coins are removed when the hand is not detected until the count time reaches a predetermined period of time.

The left coin storage portion 503 comprises a pivotal slip gate member 526A for selectively allowing coins to drop from an inclined lower portion of the reception convey path 504, a third opening/closing driving member 526B for pivoting the slip gate member 526A in directions indicated by arrows X1 and X2 in FIG. 12, and a left coin storage box 527 for storing coins dropping from the reception convey path 504. Coins are allowed to drop from the reception convey path 504 only when the slip gate member 526A is pivoted in the direction indicated by the arrow X1 in FIG. 12. Note that a third optical sensor 527A, which optically detects the recovery of left coins, is arranged near the opening of the coin storage box 527.

The reception convey path 504 is designed so that first and second endless conveyor belts 520 and 521 extend obliquely upward. A portion of the second conveyor belt 521, which opposes a lower position of the coin drop opening 512B, is formed into a holding portion 521A and collectively holds all coins dropping from the coin drop opening 512B. The coins which have dropped into the coin holding portion 521A are conveyed obliquely upward upon running of the second conveyor belt 521. In addition, a second coin count restricting roller 523 is arranged midway along this convey route. The roller 523 is rotated at a distance, corresponding to the thickness of about one or two coins, from the upper surface of the second conveyor belt 521. The passage of coins is sequentially allowed by the second coin count restricting roller 523 so that one or two coins are clamped between the first and second conveyor belts 520 and 521 and conveyed obliquely upward. A third endless conveyor belt 524 is arranged to receive the coins clamped/conveyed by the two conveyor belts 520 and 521 and convey them to a substantially horizontal position. In addition, a third coin count restricting roller 528 is arranged to be rotated at a distance, corresponding to the thickness of about of about one coin, from the upper surface of the third conveyor belt 524.

The classifying storage portion 505 comprises: a chute 530 for guiding coins downward which are conveyed one by one by the third conveyor belt 504 and the second coin count restricting roller 528, both of which are arranged above the reception convey path 504; a discriminating portion for discriminating whether the coins guided by the chute 530 can be received, e.g., an electronic coin detecting portion 531 for discriminating the denominations, authenticity, and number of coins; a branch gate portion 532 for branching acceptable coins (e.g., authentic one-yen coins, one-cent coins, 10-yen coins, one-dollar coins, and 100-yen coins) from unacceptable coins discriminated by the electronic coin detecting portion 531 during the convey operation; a discharge chute 533 for guiding the unacceptable coins separated by the branch gate portion 532 downward utilizing the force of gravity; an outer appearance sorting portion 534 for sorting the acceptable coins passing through the branch gate portion 532 in units of their denominations based of their outer sizes, and a classifying storage box 535 for storing the coins stored in units of denominations by the outer appearance sorting portion 534.

The classifying storage box 535 is partitioned into a one-cent storage region 535A, a one-yen storage region 535B, a 100-yen storage region 535C, a 10-yen storage region 535D, and a one-dollar storage region 535E. Each of the storage regions 535A to 535E includes a coin extracting mechanism, e.g., a known disk delivery unit 537. The disk delivery unit sequentially extracts coins one by one and discharges them into a dispensation chute 536. Note that a first counting means 538 is arranged at an upper end portion of the dispensation chute 536 to optically or mechanically count dropping coins.

A first storage amount detecting means 540 is arranged as a recovery signal output means for designating recovery processing of coins stored in one of the storage regions 535A to 535E. For example, the first storage amount detecting means 540 discriminates the amount of coins stored in each of the storage regions 535A to 535E (e.g., optically detects that the amount of stored coins is increased to a predetermined amount), and outputs a recovery signal to the mechanism control section 151. In addition, a second storage amount detecting means 541 is arranged as a replenishment signal output means for designating replenishment of a predetermined one of the storage regions 535A to 535E with coins. For example, the second storage amount detecting means 541 discriminates the amount of coins stored in each of the storage regions 535A to 535E (e.g., optically detects that the amount of stored coins is decreased to a predetermined amount), and outputs a replenishment signal to the mechanism control section 151.

The discharge convey path 507 and the recovery convey path 508 comprise: a fourth endless conveyor belt 544 driven in a direction indicated by an arrow W1 or W2 in FIG. 12 and arranged in the form of a recess so that a part of its running surface is located below the discharge chute 533 and the dispensation chute 536; a fifth endless conveyor belt 545 in contact with the right vertical upright surface of the fourth conveyor belt 544; a sixth endless conveyor belt 526 in contact with the left vertical upright surface of the fourth conveyor belt 544; a fourth coin count restricting roller 547, which rotates at a distance corresponding to the thickness of about one or two coins from the right horizontal surface of the fourth conveyor belt 544; and a fifth coin count restricting roller 548, rotates a distance corresponding to the thickness of about one or two coins from the left horizontal surface of the fourth conveyor belt 544.

In the above-described arrangement, coins to be discharged and dispensed are clamped/conveyed by the fourth and sixth conveyor belts 544 and 546 and discharged into the received/dispensed coin introduction portion 502. Coins to be recovered are clamped/conveyed by the fourth and fifth conveyor belts 544 and 545 and preserved in the preserving portion 509. Note that the first, second, fourth, fifth, and sixth conveyor belts 520, 521, 544, 545, and 546, and the second, fourth, and fifth coin count restricting rollers 523, 547, and 548 are driven by a first motor 550.

The preserving portion 509 is constituted by a preserving box 551 having an introduction opening portion 551A where coins clamped/conveyed by the fourth and fifth conveyor belts 544 and 545 are introduced, and a feed opening portion 551B through which stored coins are fed.

The convey path 510 comprises a seventh endless conveyor belt 552, for conveying coins introduced into the preserving box 551 toward the feed opening portion 551B, and a sixth coin count restricting roller 553, which rotates a distance corresponding to the thickness of about one or two coins from the upper surface of the seventh conveyor belt 552. Coins for replenishment fed from the feed opening portion 551B drop on the third conveyor belt 524, which constitutes a part of the reception convey path 504, so that the coins are conveyed forward. Note that since the denominations and number of coins for replenishment are detected when they pass through the electronic coin detecting portion 531, the detecting portion 531 also serves as a second counting means for counting the number of coins provided for replenishment.

Figure 13:
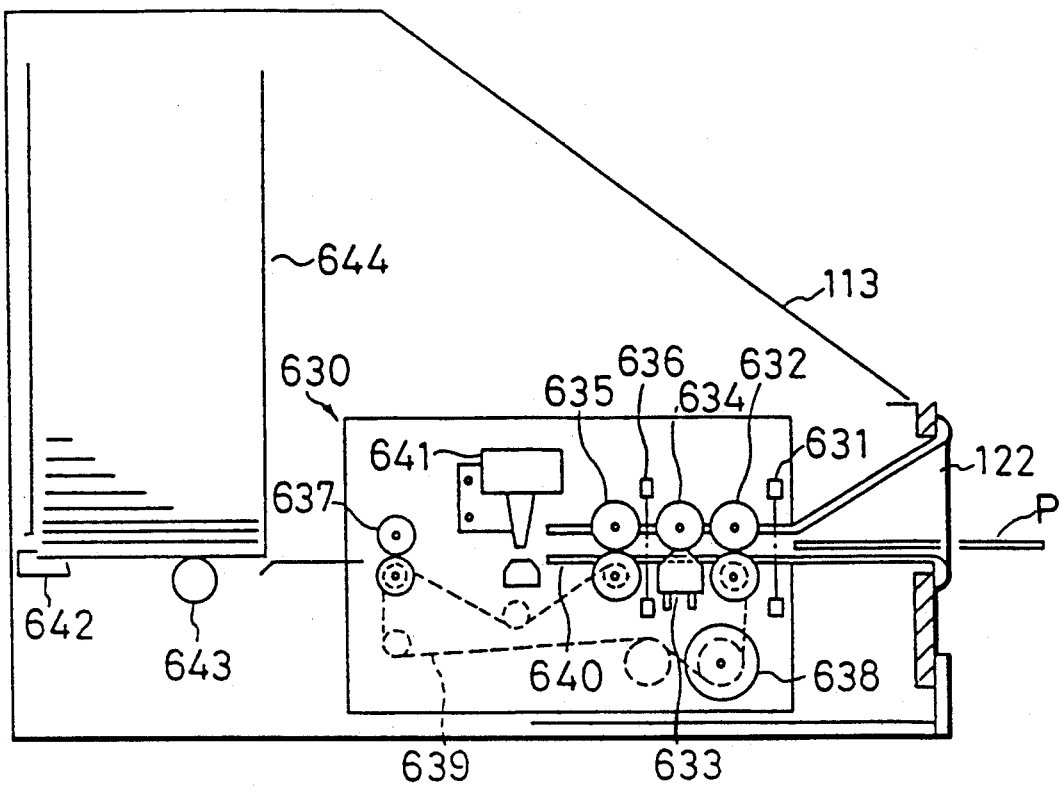
FIG. 13 is a sectional view showing a structure of a card reader/writer.

FIG. 13 shows the card issue printer 115. The card insertion slit 122 is formed in the front surface of the card issue printer 115. The card reader/writer 113 is arranged behind the card insertion slit 122. The card reader/writer 113 includes a first sensor 631 for optically detecting a prepaid card (hereinafter a card) P as a token card to be inserted in the card insertion slit 122. A card receiving roller pair 632 is arranged behind the sensor 631. A magnetic head 633 and a pinch roller 634 opposing thereto are arranged adjacent to the roller 632. A roller pair 635 is arranged adjacent to the magnetic head 633 and the pinch roller 634.

A second sensor 636 is arranged between the magnetic head 633 and the roller pair 635. A drive roller pair 637 is arranged behind the roller pair 635. The drive roller pair 637 and the roller pairs 632 and 635 are rotated by a belt 639, which is driven by a motor 638.

A guide plate 640 is arranged along a card convey path constituted by the drive roller pair 637 and the roller pairs 632 and 635. A printer 641 is arranged near the drive roller pair 637 to print data on the upper surface of the card P. In addition, a card storage portion 644 is arranged behind the printer 641 to store cards P that will be. The cards P are taken out by a picker knife 642 and a roller 643. The printer 641 and the magnetic head 633 serve to record the amount of small change on a card P and record a predetermined amount of money on a card P that will be issued.

Figure 14A:
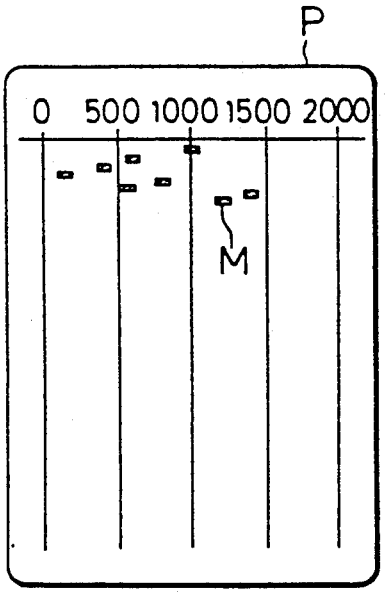
FIGS. 14A and 14B are plan views showing an arrangement of a prepaid card.

The card P will be described below. The card P is a prepaid card used as a token. A prepaid amount of money is set as the value of the card P, e.g., 1,000-yen. As shown in FIG. 14A, a print region, on which marks "M" are printed, is formed on the upper surface of the card P. Each mark "M" indicates an approximate balance as the value of the card P, which varies upon every transaction. For example, this print region is divided into "0", "500", "1000", "1500", and "2000" areas in correspondence with the prepaid amount of the card P. Upon every transaction, the mark "M" is printed at a position corresponding to the balance of the card P.

Figure 14B:
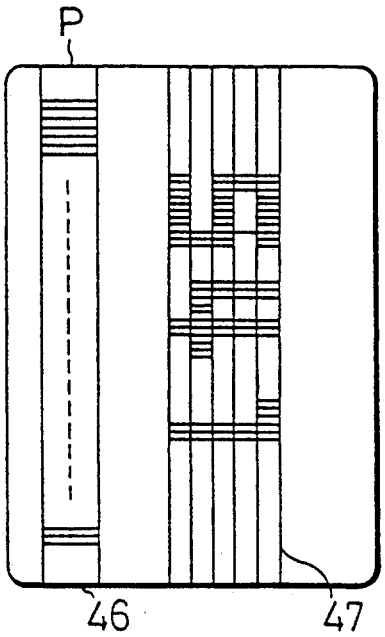

For example, the lower surface of the card P as shown in FIG. 14B, magnetic strip portions 646 and 647 are formed where data is read/written from/in by the magnetic head 633. On the magnetic strip portion 646, for example, a user number for customer management, and the latest balance amount, which varies upon every transaction, are magnetically recorded as digital data. For example, the magnetic strip portion 647 is constituted as a multitruck divided into five trucks, and information indicating the latest balance amount is magnetically recorded on each track so as to be updated by using parallel magnetic inversion lines. This information can be visualized by a viewer, thus displaying an accurate balance.

Figure 15:
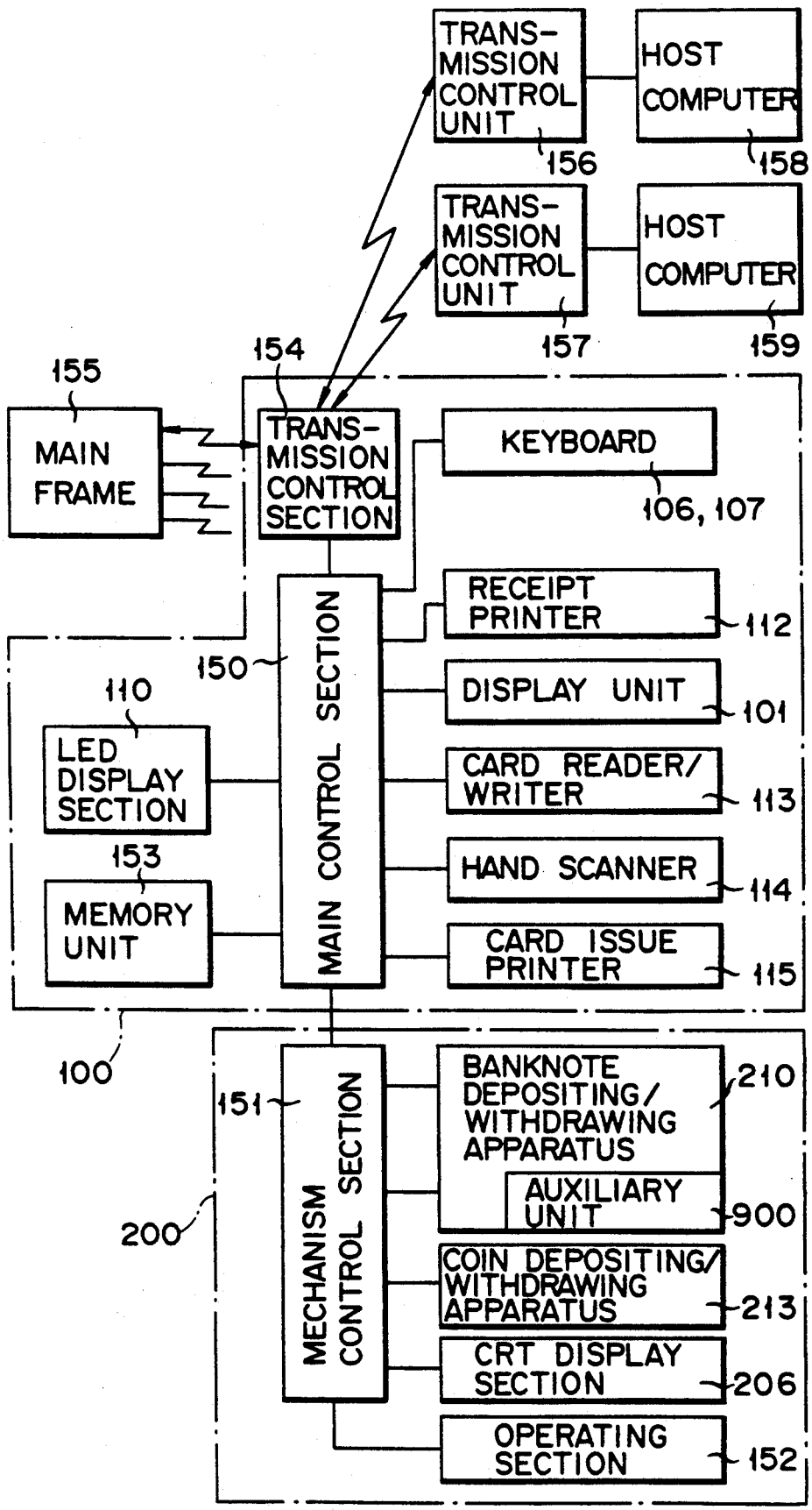
FIG. 15 is a control block diagram showing an arrangement of the POS terminal apparatus.
Figure 16:
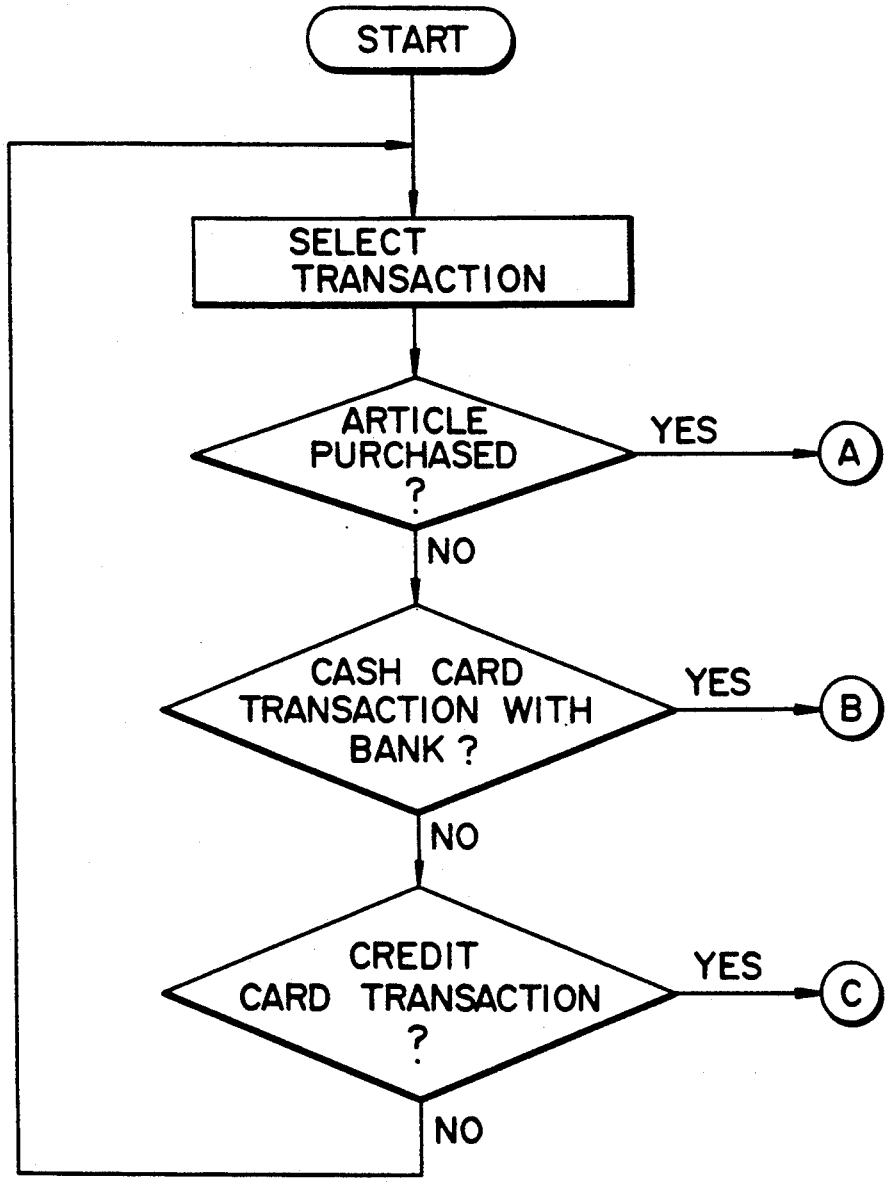
FIGS. 16 to 19 are flow charts for explaining operations of the POS terminal apparatus.
Figure 17:
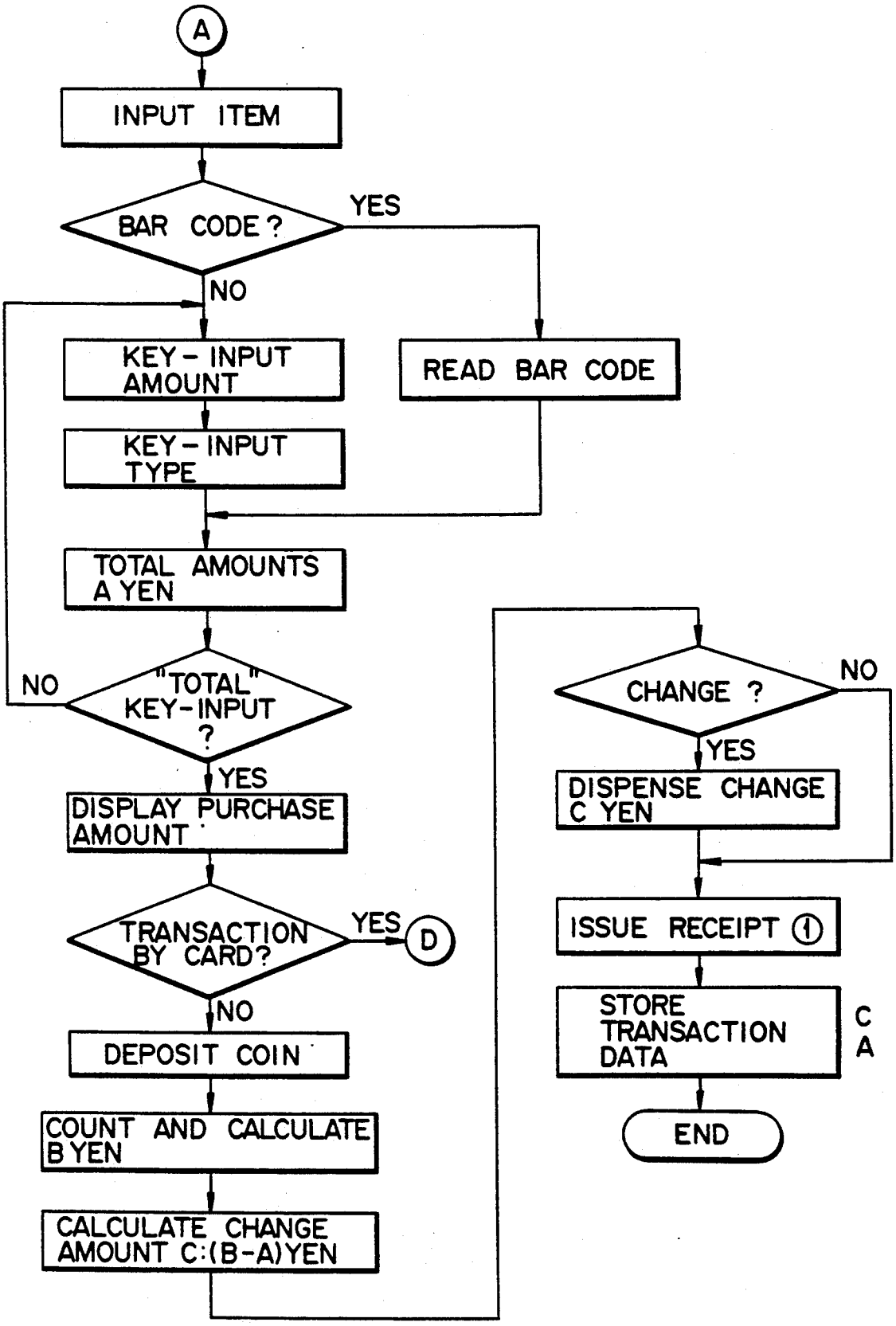
Figure 18:
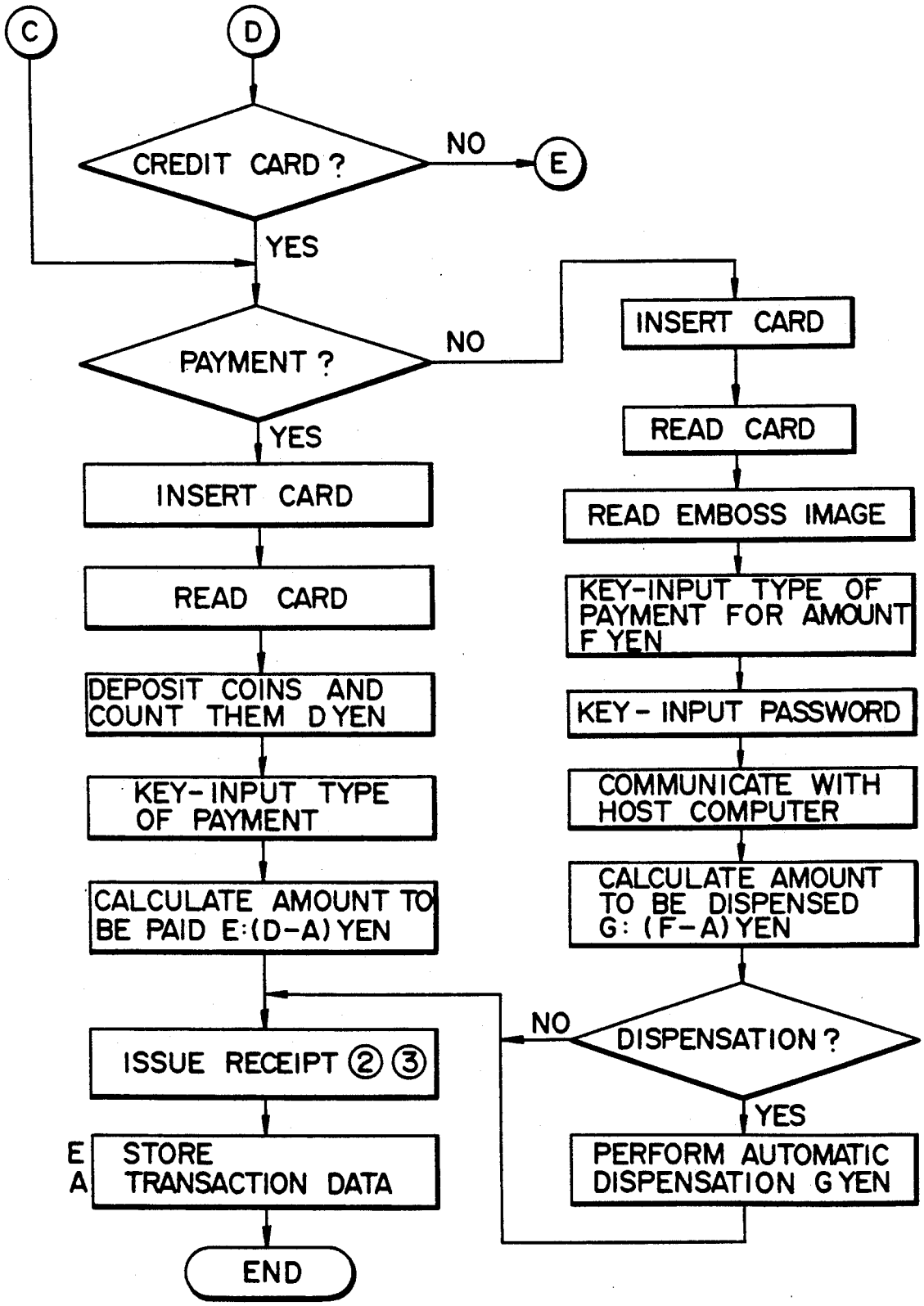
Figure 19:
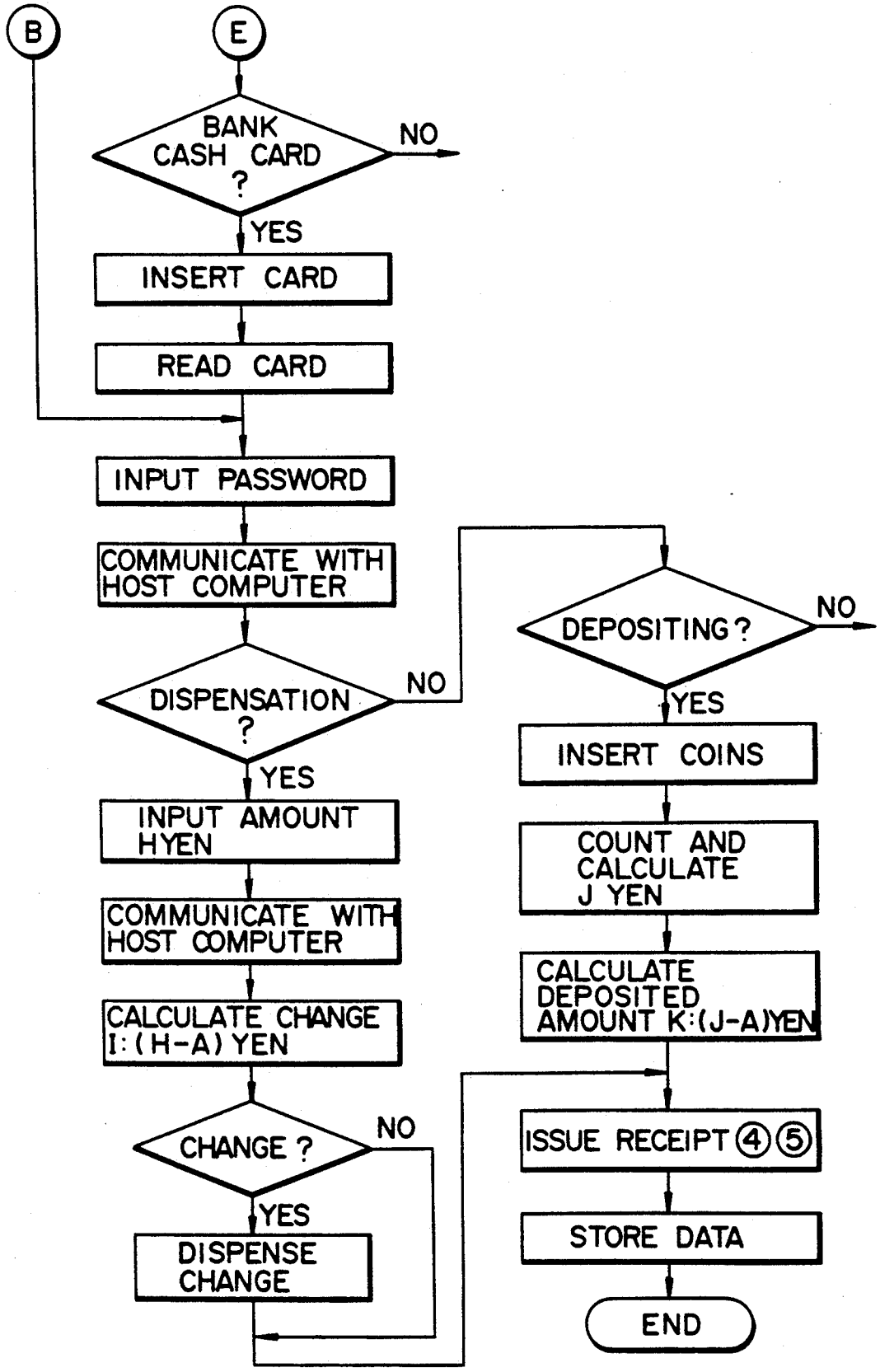

FIG. 15 is a control block diagram of the POS terminal apparatus 1 described above. The cash register 100 comprises: a main control section 150; a keyboard section 116; an LED numeric display unit 110; a memory unit 153; and a transmission control section. The main control section is for controlling the overall cash register 100, the receipt printer 112, which prints account titles and the like on a receipt discharged from the receipt outlet 105, the card reader writer 113, for reading an account number from a card inserted from the card insertion slit 102, the hand scanner 114, for automatically reading a department, a price, and the like represented by bar codes marked on an article, the card issue printer 115, for printing information on the card P inserted from the card insertion slit 122 and reading/writing magnetic information from/on the card P. The key input section 116 is constituted by the ten-key pad 106 and the item key section 107. The LED numeric display unit 110 informs a purchase amount to a customer. The memory unit 153 stores transaction information. The transmission control section 154 performs data exchange with an external unit.

The depositing/withdrawing apparatus 200 comprises the mechanism control section 151 for controlling the overall apparatus 200, the banknote depositing/withdrawing apparatus 210, a coin depositing/withdrawing apparatus 213, the CRT display section 206, and an operating section 152. The operating section 152 is constituted by the ten-key pad 207 and the selection keys 208.

The main control section 150 of the cash register 100 and the mechanism control section 151 of the depositing/withdrawing apparatus 200 are connected to exchange data between each other.

The transmission control section 154 of the cash register 100 is connected to a main frame 155, which is a central processing unit as a POS center through a communication line. The main frame 155 stores and manages sales data, such as article names and prices, transmitted from the cash register 100. With this operation, the sales amounts of specific articles at the cash register 100 or a shop can be totaled in real time, thus allowing automatic management of replenishment, shipment, and delivery. In addition, the transmission control section 154 of the cash register 100 is on-line-connected to a host computer 158 of a bank or a host computer 159 of a credit company through a communication line (not shown) and a transmission control unit 156 or 157.

An operation of the POS terminal apparatus 1 having the above-described arrangement will be described below with reference to the flow charts shown in FIGS. 16 to 19.

An operator, i.e., a clerk in a convenience store, inputs a type of transaction by using the item key section 107 of the cash register 100.

When articles are purchased, the clerk operates the hand scanner 114 to read bar cords, or inputs purchase amounts by using the item key section 107 and the ten-key pad 106. In accordance with this input, the main control section 150 sequentially stores purchase information in the memory unit 153.

If the end key 108 is depressed by the clerk, the main control section 150 calculates a total purchase amount on the basis of the purchase information stored in the memory unit 153. The main control section 150 then displays the total purchase amount to the customer by using the LED display section 110.

Furthermore, the clerk inquires of the customer how he/she pays. If the customer pays in cash, the clerk informs the customer how to deposit cash. In accordance with this information, the customer inserts banknotes and coins in the depositing/withdrawing opening 204 and the coin depositing/withdrawing opening 209, respectively. The inserted cash is counted by a counting circuit (not shown) in the depositing/withdrawing apparatus 200. The count result is output to the main control section 150. The main control section 150 compares the amount of cash inserted by the customer and counted by the depositing/withdrawing apparatus 200 with the total purchase amount, thereby checking whether change is required. If change is required, the main control section 150 outputs the data of the amount of change to the depositing/withdrawing apparatus 200, and outputs the purchase information to the receipt printer 112. The depositing/withdrawing apparatus 200 then dispenses the change amount designated by the main control section 150, and the receipt printer 112 issues a receipt on which the purchase information shown in FIG. 20A is printed. The main control section 150 stores the purchase information as transaction data in a transaction data storage area of the memory unit 153. Upon completion of the transaction, the clerk hands the articles and a receipt to the customer.

If no change is required, the main control section 150 outputs the purchase information to the receipt printer 112. After this operation, the receipt printer 112 issues a receipt on which the purchase information is printed under the control of the main control section 150. If the amount of inserted cash is smaller than the purchase amount, the transaction is not established, and the flow of processing shifts to error processing and instructs the customer to insert cash corresponding to the shortage.

If the customer pays by a card transaction, the clerk requires the customer to present a card.

In accordance with this requirement, the customer presents the card. The clerk receives the card and checks whether it is a credit card or a cash card, thus inputting the data associated with the type of liquidation by using the item key section 107.

If "payment by credit card" is input, the control section 150 displays "Are you paying for credit?" as a guide on the CRT display section 206. In response to this guide, the customer chooses a payment for credit or another type of payment by using the selection keys 208.

When the payment on credit is selected, the clerk inserts the credit card in the card insertion slit 102. The card reader/writer then reads an account number and the like from the magnetic strip of the credit card inserted in the card insertion slit 102. This information is output to the main control section 150. The main control section 150 stores the read information in its internal memory (not shown) and displays "Please insert cash" as a guide message on the CRT display section 206. In response to this command, the customer inserts banknotes in the depositing/withdrawing opening 204 and closes the opening 204. The inserted cash is counted by the counting circuit (not shown) in the depositing/withdrawing apparatus 200, and the count result is output to the main control section 150 through the mechanism control section 151. The main control section 150 compares the amount of cash inserted by the customer and counted by the depositing/withdrawing apparatus 200 with the total purchase amount, thus checking whether change is required. If change is required, the main control section 150 determines that the change amount corresponds to a payment amount for the credit. The main control section then transmits the data of the payment amount and the account number of the credit card to the host computer 159 of the credit company through the transmission control section 154, the communication line, and the transmission control unit 157. Subsequently, the host computer 159 subtracts the payment amount from the credit amount corresponding to the account number supplied from the host computer 159. In addition, the main control section 150 outputs the purchase information and the credit payment information to the receipt printer 112. After this operation, the receipt printer issues a receipt on which the purchase information and the credit payment information shown in FIG. 20B are printed. The main control section 150 stores the purchase information and the credit payment information as transaction data in the transaction data storage area of the memory unit 153. Upon establishment of the transaction, the clerk hands the articles, the credit card, and the receipt to the customer.

If the amount of inserted cash is equal to or smaller than the purchase amount, the transaction is not established, and the flow of processing shifts to error processing and, instructs the customer to insert cash corresponding to the shortage.

It "loan" is selected instead of "payment for credit", the clerk inserts the credit card into the card insertion slit 102. The card reader/writer 113 reads an account number and the like from the magnetic stripe of the credit card inserted into the card insertion slit 102. The read information is output to the main control section 150. The main control section 150 stores the read information in the internal memory (not shown). In addition, the clerk operates the hand scanner 114 to read an emboss image of the upper surface of the credit card discharged from the card reader/writer 113. The emboss image read by the hand scanner 114 is stored in the internal memory.

The main control section 150 displays "Please enter a cashing amount, the type of payment, and the password in this order" as a guide on the CRT display section 206. In response to this guide, the customer enters a cashing amount by the ten-key pad 207; the type of payment (normal, payment in installments, or collective payment by a bonus), by the selection keys 208; and the password by the ten-key pad 207.

The main control section 150 transmits the data associated with the account number of the credit, the cashing amount, the type of payment, and the password to the host computer 159 of the credit company through the transmission control section 154, the communication line, and the transmission control unit 157. Subsequently, the host computer 159 checks the account, the amount of money used in the current month, and the password on the basis of the supplied data. If a problem is not posed, the transaction is permitted. The transaction permission signal from the host computer 159 is transmitted to the main control section 150 through the transmission control unit 157, the communication line, and the transmission control section 154. In response to the transaction permission signal, the main control section 150 subtracts the purchase amount from the cashing amount to obtain an actual amount of money to be dispensed, and outputs the data of the amount of money to be dispensed to the depositing/withdrawing apparatus 200. In addition, the main control section 150 outputs the cashing information and the purchase information to the receipt printer 112. After this operation, the depositing/withdrawing apparatus 200 dispenses cash corresponding to the amount designated by the main control section 150, and the receipt printer 112 issues a receipt on which the cashing (credit loan) information and the purchase information shown in FIG. 20C are printed. The main control section 150 stores the cashing information and the purchase information as transaction data in the transaction data storage area of the memory unit 153. Upon completion of the transaction, the clerk hands the articles, the receipt, and the credit card to the customer.

If "payment by a cash card" is entered as the type of payment, the clerk insets the cash card into the card insertion slit 102. The card reader/writer 113 reads an account number and the like from the magnetic strips of the cash card inserted into the card insertion slit 102. The read information is then output to the main control section 150. The main control section 150 stores the read information in the internal memory (not shown), and displays "Please enter password" as a guide on the CRT display section 206.

In response to this guide, the customer enters the password by the ten-key pad 207.

The main control section 150 transmits the data associated with the account number and password of the cash card to the host computer 158 of the bank through the transmission control section 154, the communication line, and the transmission control unit 156. Subsequently, the host computer 158 checks the account and the password on the basis of the supplied account number and password data. If no problem is posed, the transaction is permitted. The transaction permission signal from the host computer 159 is transmitted to the main control section 150 through the transmission control unit 156, the communication line, and the transmission control section 154. In response to the transaction permission signal, the main control section 150 displays "Please enter 'withdrawn' or 'deposit'" as a guide on the CRT display section 206. In response to this guide, the customer enters "withdrawn" or "deposit" by using the selective keys 208.

If "withdraw" is selected by the customer in response to this guide, the main control section 150 displays "Please enter an amount of money to be withdrawn" as a guide on the CRT display section 206. In response to this guide, the customer enters an amount of money to be withdrawn using the ten-key pad 208.

The main control section 150 transmits the data of the amount of money to be withdrawn to the host computer 158 of the bank through the transmission control section 54, the communication line, and the transmission control unit 156. Subsequently, the host computer 158 checks whether cash corresponding to the supplied data can be dispensed. If no problem is posed, the host computer 158 outputs a dispensation permission signal. The dispensation permission signal is transmitted to the main control section 150 through the transmission control unit 156, the communication line, and the transmission control section 154. In response to the dispensation permission signal, the main control section 150 compares the amount of money to be withdrawn with the total purchase amount, thus checking whether change is required. If change is required, the main control section 150 outputs the data of the change amount to the depositing/withdrawing apparatus 200, and outputs the purchase information to the receipt printer 112. With this operation, the depositing/withdrawing apparatus 200 dispenses cash corresponding to the amount of money designated by the main control section 150. Meanwhile, the receipt printer 112 issues a receipt on which the purchase information and the change information shown in FIG. 20D are printed. The main control section 150 stores the purchase information as transaction data in the transaction data storage area of the memory unit 153. Upon completion of the transaction, the clerk hands the articles, the cash card, and the receipt to the customer.

If no change is required, the main control section 150 outputs the purchase information to the receipt printer 112. Subsequently, the receipt printer 112 issues a receipt on which the purchase information is printed under the control of the main control section 150. If the amount of money to be withdrawn is smaller than the purchase amount, the transaction is not established, and the flow of processing shifts to error processing for insertion of cash corresponding to the shortage.

If "deposit" is selected by the customer, the main control section 150 displays "Please enter cash" as a guide on the CRT display section 206.

In response to this guide, the customer inserts banknotes and coins in the depositing/withdrawing opening 204 and the coin depositing/withdrawing opening 29, respectively. The inserted cash is counted by the count circuit (not shown) in the depositing/withdrawing apparatus 200. The count result is output to the main control section 150. The main control section 150 compares the amount of cash inserted by the customer and counted by the depositing/withdrawing apparatus 200 with the total purchase amount, thus checking whether change is required. If change is required, the main control section 150 transmits the data of the change amount as the amount of deposited cash to the host computer 158 of the bank through the transmission control section 154, the communication line, and the transmission control unit 156. Subsequently, the host computer 158 checks whether cash corresponding to the supplied data can be deposited. If no problem is posed, the depositing operation is permitted. The depositing permission signal from the host computer 158 is transmitted to the main control section 150 through the transmission control unit 156, the communication line, and the transmission control section 154. In response to the depositing permission signal, the main control section 150 outputs the purchase information to the receipt printer 112. The receipt printer 112 issues a receipt on which the information of the amount of deposited cash and the purchase information shown in FIG. 20E are printed. The main control section 150 stores the purchase information and the information of the amount of deposited cash as transaction data in the transaction data storage area of the memory unit 153. Upon completion of the transaction, the clerk hands the articles, the cash card, and the receipt to the customer.

If no change is required, the main control section 150 outputs the purchase information to the receipt printer 112. The receipt printer 112 issues a receipt on which the purchase information is printed under the control of the main control section 150. If the amount of deposited cash is smaller than the purchase amount, the transaction is not established, and the flow of processing shifts to error processing for redepositing cash corresponding to the shortage.

In the embodiment described above, cash is to be deposited by a customer. However, if cash is to be handed to a clerk, the clerk may deposit the cash.

More specifically, banknotes can be deposited through the auxiliary safe unit apparatus 900, and coins can be deposited through the preserving box 551. In addition, the deposited cash can be automatically counted (see FIG. 12).

In the above-described embodiment, since cash in the depositing/withdrawing apparatus 200 is supplied from a bank, transaction data is managed in the manner shown in FIG. 21 and is stored in the memory unit 153. In a storage format of the memory unit 153, 1 to 3 indicate actual deposited/withdrawn cash data; 4 and 5, the amount of cash withdrawn/deposited from/in the account of the customer; 6 and 7, the credit transaction amounts of the customer; 8, an amount of money of a credit transaction (part of 7); 9, an amount of money paid from the account of the customer (part of 4); 10, the amount of cash deposited by hand; and 11, the amount of cash withdrawn as change (paid from the bank account of a shop). The contents of 4 and 5 are transmitted to the host computer 158 of the bank to perform processing for the account of the customer. The contents of 9 are transmitted to the bank to perform processing for the account of the shop. Similarly, the contents of 6 to 8 are transmitted to the host computer 159 of the credit company.

In the embodiment described above, since payment processing is performed among the shop, the bank, and the credit card company, various types of data slips are issued in business operations, and complicated operations may be required.

In order to solve such a problem, when only a purchase transaction is to be performed, banknotes are deposited from the hopper 910 into the auxiliary safe 940 by using the auxiliary safe unit apparatus 900. If a transaction includes a credit transaction or a bank transaction, banknotes are received or dispensed in or from the safe 16 and 17 through the depositing/withdrawing opening 7.

Even if a transaction includes a credit or bank transaction, cash corresponding to the sales amount of the shop is extracted from the safes 16 and 17 to be stored in the auxiliary safe 940. In this case, similar to the banknotes, coins are received in the coin auxiliary safe 290 set in the coin processing unit shown in FIG. 12, thus storing the cash corresponding to the sales amount of the shop independently of other cash. In this case, therefore, since the cash (sales) of the shop is clearly separated from other cash, data slips are issued only between the shop and the bank and between the credit company and the bank. This reduces the complicatedness of operations. The shop is only required to perform total management of the contents of 8 to 10 as a sales amount and to manage the change amount of 11.

Figure 22:
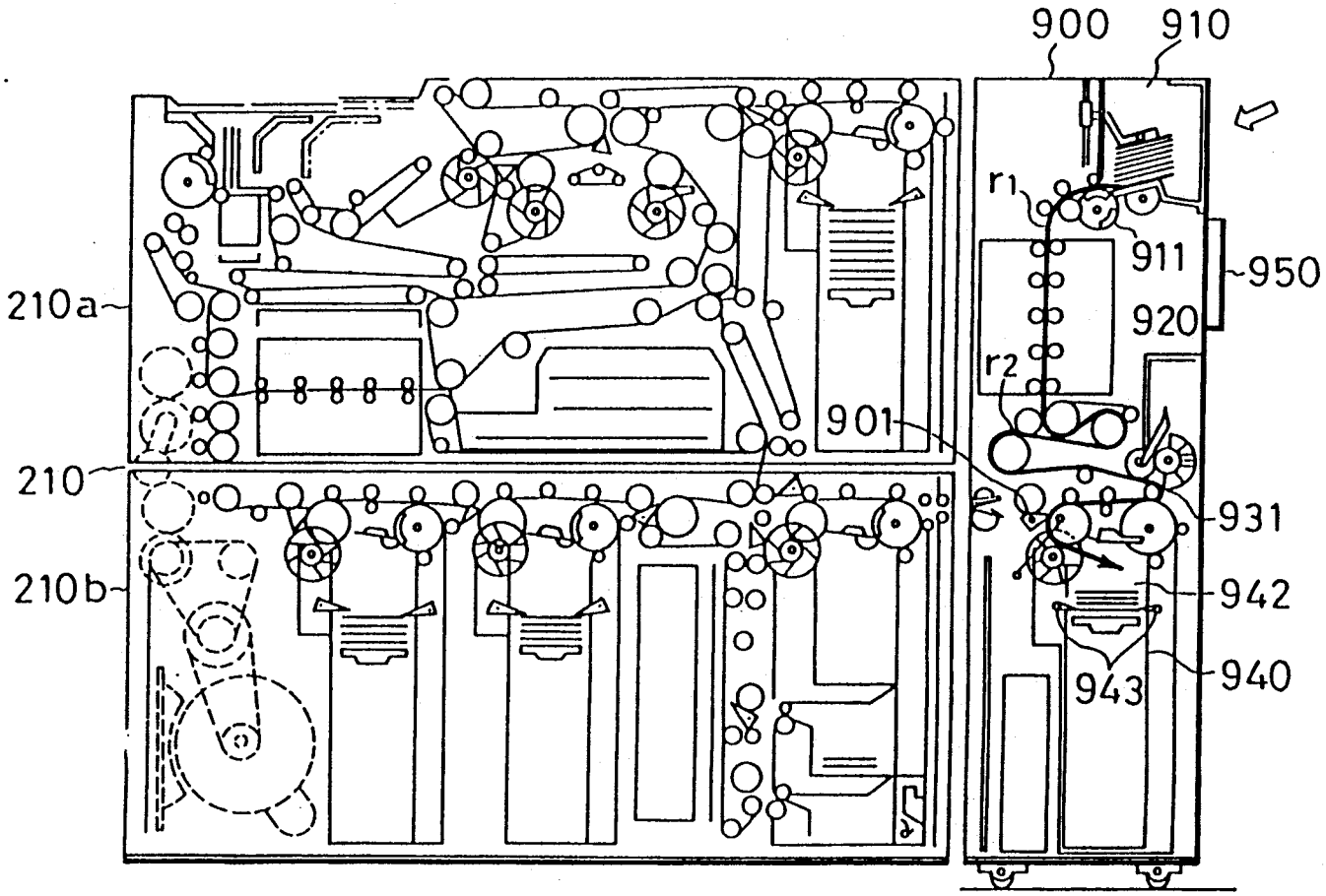
FIG. 22 is a sectional view showing the flow of banknotes in a case wherein banknotes handed to a clerk are stored in an auxiliary safe.
Figure 23:
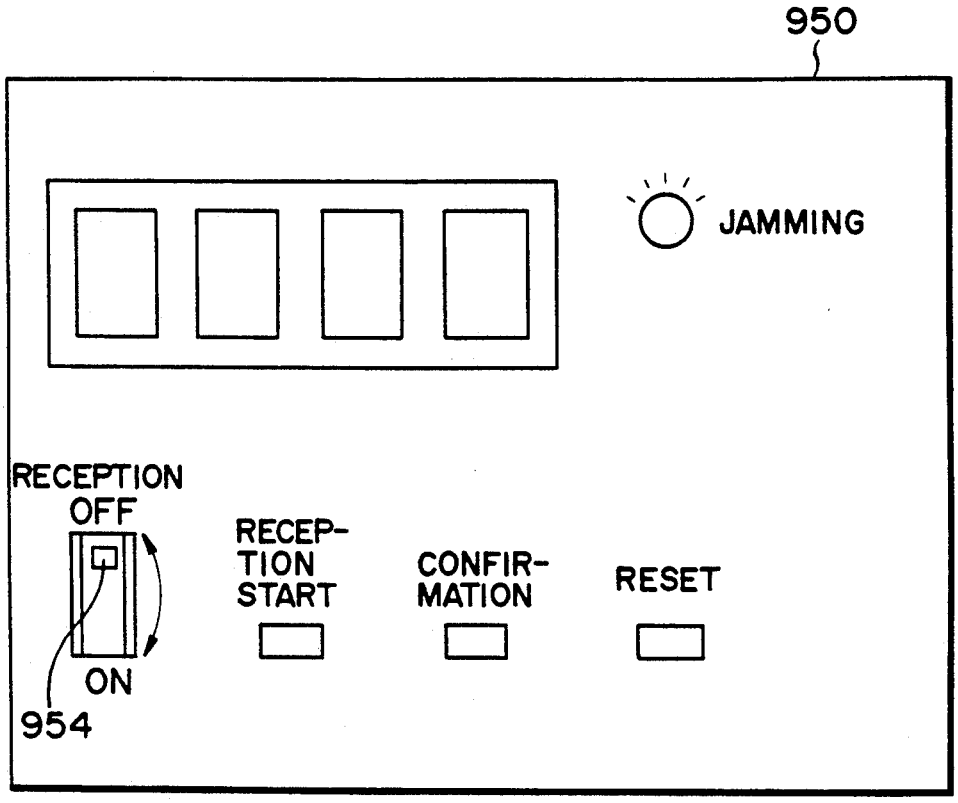
FIG. 23 is a plan view for explaining an operation panel.
Figure 24:
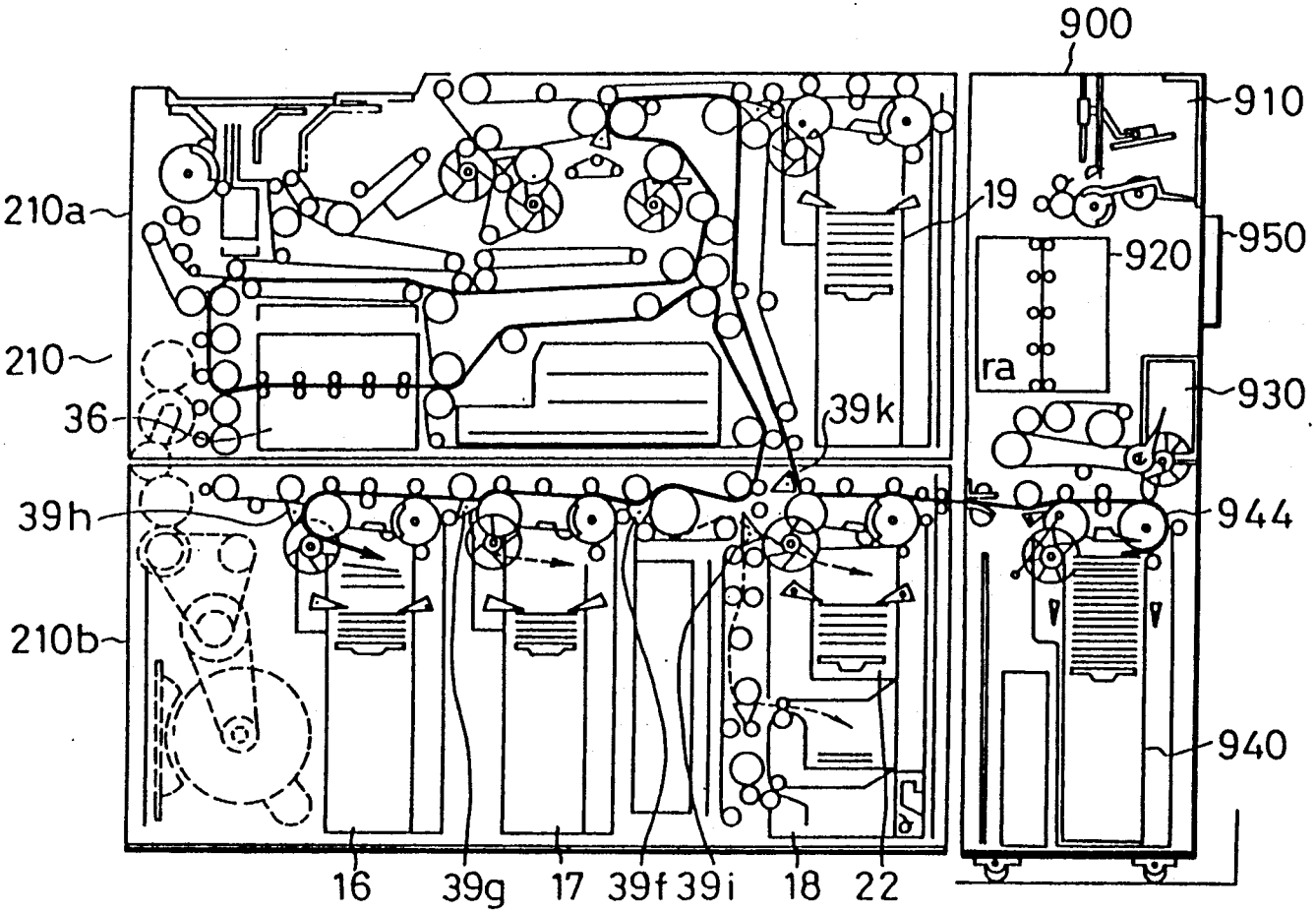
FIG. 24 is a sectional view showing the flow of banknotes in a case wherein banknotes from an auxiliary safe are stored in a depositing safe.

In the above-described embodiment, the cash in the depositing/withdrawing apparatus is supplied from the bank. However, the present invention is not limited to this. For example, the auxiliary safe unit apparatus 900 may be used as a depositing apparatus for a clerk. More specifically, as shown in FIG. 22, banknotes deposited by hand are stored in the auxiliary safe 940. When the reception button 954 in the operation panel 950 shown in FIG. 23 is turned on, banknotes in the auxiliary safe 940 are stored in the depositing safes 16 and 17 (see FIG. 24), and a signal representing that the banknotes are deposited in the account of the shop is transmitted (informed) to the host computer 158. Accordingly, are under the management of the shop when they are stored in the auxiliary safe 940. The shope can also arbitrarily choose turn-ON of the reception button 954 to deposit the banknotes or withdrawal of the banknotes from the auxiliary safe 940 and use them for other purposes.

In addition, the above-described prepaid card P is used as change. If a customer requires a card instead of change, the prepaid card P on which a change amount is recorded is issued, as described with reference to FIGS. 13 and 14.

Figure 25:
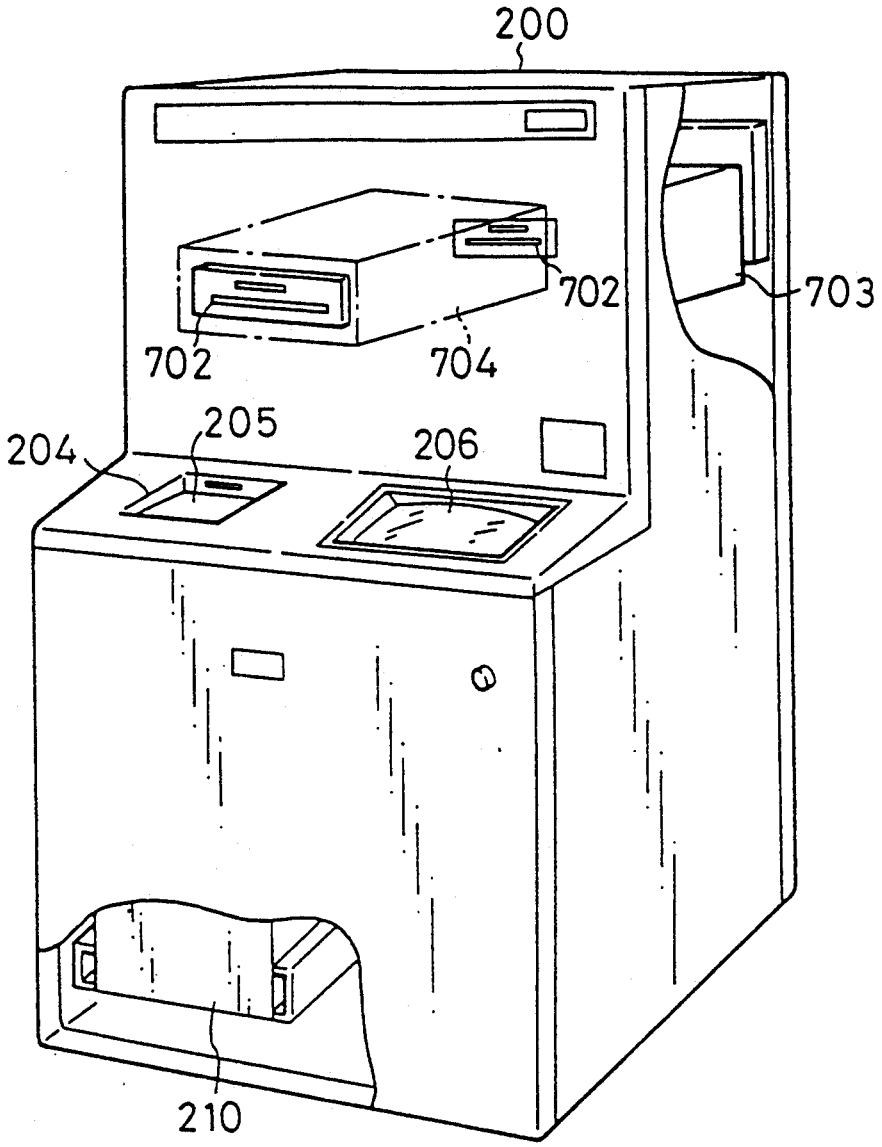
FIG. 25 is a perspective view showing an outer appearance of a depositing/withdrawing apparatus according to another embodiment of the present invention.

In the embodiment described above, reading of the credit card and the cash card is performed on the cash register 100 side. However, such an operation may be performed on the depositing/withdrawing apparatus side, as shown in FIG. 25. In this case, the depositing/withdrawing apparatus 200 has a card insertion slit 701 and a banknote insertion slit 702. In addition, a card processing unit 703 and a bankbook processing unit 704 are arranged in the apparatus 200. With this arrangement, when a transaction does not include the purchase of articles, depositing/withdrawing processing and credit load/payment processing can be performed by only an operation performed by a customer.

In the embodiment described above, yen is used as a circulating currency. However, the present invention can be applied to other circulating currencies such as dollars. Such an application is apparent to those skilled in the art.

The embodiment described above is associated with a cash processing apparatus. However, the present invention can be applied to an apparatus for processing transactions by using cards.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A point of sales apparatus including a depositing-/withdrawing apparatus, comprising:

first means for determining a total sales amount of at least one article sold to a customer;

second means for receiving cash from the customer;

third means for identifying the denominations of the cash and the number of bank notes and coins involved in the cash;

fourth means for determining the amount of cash received from the customer on the basis of the denominations and the number of banknotes and coins identified by the identifying means;

fifth means for storing the cash identified by said second means;

sixth means connected to the first and fourth means for calculating the difference between the total sales amount and the amount of cash from the customer;

reading means for reading an account information of the customer from an identity medium;

designating means for designating a payment mode to the customer, either payment in credit, cash or to a prepaid card;

depositing means, connected to the sixth means and the reading means, for automatically depositing the difference calculated by the sixth means to the account corresponding to the account information read by the reading means when said designation means designates payment by credit;

dispensing means for dispensing cash corresponding to the difference calculated by the sixth means when said designating means designates payment in cash; and dispensing means for dispensing a prepaid card corresponding to the difference calculated by the sixth means when said designating means designates payment by prepaid card.

2. A terminal apparatus for use in an article sales system, comprising:

first means for determining total sales amount of at least one article sold to a customer;

reading means for reading account data from an identity medium;

designating means for designating an amount of money to be withdrawn from the account read by the reading means;

second means connected to the first means and designating means for calculating the difference between the total sales amount and the amount of money to be withdrawn;

payment-mode designating means for designating a payment mode to the customer, said payment mode being either payment in cash or payment to a prepaid card;

dispensing means for either dispensing cash or a prepaid card, corresponding in value to the difference calculated by the second means, in response to the payment mode designated by the payment-mode designating means; and settling means for withdrawing the designated amount of money from the customers account corresponding to the account data read by the reading means.

* * * * *